US011466528B2

(12) United States Patent
Cho et al.

(10) Patent No.: US 11,466,528 B2
(45) Date of Patent: Oct. 11, 2022

(54) MULTILATERAL MULTISTAGE SYSTEM AND METHOD

(71) Applicant: Halliburton Energy Services, Inc., Houston, TX (US)

(72) Inventors: Brian Williams Cho, Katy, TX (US); Matthew James Kelsey, Cypress, TX (US); Casey James Alvin Brown, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 136 days.

(21) Appl. No.: 16/675,782

(22) Filed: Nov. 6, 2019

(65) Prior Publication Data

US 2020/0149363 A1 May 14, 2020

Related U.S. Application Data

(60) Provisional application No. 62/757,941, filed on Nov. 9, 2018.

(51) Int. Cl.

| | |
|---|---|
| ***E21B 23/00*** | (2006.01) |
| ***E21B 43/26*** | (2006.01) |
| ***E21B 41/00*** | (2006.01) |

(52) U.S. Cl.

CPC ..... *E21B 23/006* (2013.01); *E21B 41/0035* (2013.01); *E21B 43/26* (2013.01)

(58) Field of Classification Search

CPC ..... E21B 23/00; E21B 23/004; E21B 23/006; E21B 41/0035; E21B 41/0042

See application file for complete search history.

(56) References Cited

U.S. PATENT DOCUMENTS

| | | | | |
|---|---|---|---|---|
| 6,752,211 | B2 | 6/2004 | Dewey et al. | |
| 7,416,029 | B2 * | 8/2008 | Telfer | E21B 23/006 166/386 |
| 8,985,203 | B2 | 3/2015 | Stokes et al. | |
| 9,140,082 | B2 | 9/2015 | Lajesic | |
| 9,243,465 | B2 | 1/2016 | Lajesic | |
| 9,260,945 | B2 | 2/2016 | Lajesic et al. | |
| 9,638,008 | B2 | 5/2017 | Stokes et al. | |

(Continued)

FOREIGN PATENT DOCUMENTS

| | | |
|---|---|---|
| RU | 2444607 C1 | 3/2012 |
| RU | 125247 U1 | 2/2013 |
| SU | 840285 A1 | 6/1981 |

*Primary Examiner* — Kristyn A Hall

(74) *Attorney, Agent, or Firm* — Scott Richardson; Parker Justiss, P.C.

(57) ABSTRACT

Provided herein is an intervention tool and a method for fracturing multiple lateral wellbores in a well system. The intervention tool, in one aspect, includes a radial outer housing, the radial outer housing forming an interior bore configured to flow fluid, and an expansion member coupled proximate an outer surface of the radial outer housing. The intervention tool according to this aspect further includes a sliding sleeve positioned along an interior surface of the radial outer housing and engageable with the expansion member, the sleeve including a collection of slots or catches configured to move the expansion member between a radially retracted position when the sliding sleeve is in a first linear position and a radially expanded position when the sliding sleeve is in a second linear position.

20 Claims, 19 Drawing Sheets

(56) References Cited

U.S. PATENT DOCUMENTS

| | | | | |
|---|---|---|---|---|
| 9,803,438 | B2 | 10/2017 | Stokes et al. | |
| 2008/0251250 | A1 | 10/2008 | Brezinski et al. | |
| 2012/0031617 | A1 | 2/2012 | Xu | |
| 2013/0025876 | A1 | 1/2013 | McCoy et al. | |
| 2013/0112435 | A1 | 5/2013 | Fleming et al. | |
| 2014/0102797 | A1* | 4/2014 | Mahajan | E21B 7/28 175/57 |
| 2014/0124220 | A1* | 5/2014 | Stautzenberger | E21B 23/006 166/381 |
| 2015/0218899 | A1 | 8/2015 | Stokes | |
| 2015/0226042 | A1* | 8/2015 | Barker | E21B 41/0042 166/381 |
| 2016/0153253 | A1 | 6/2016 | Stokes et al. | |
| 2017/0067321 | A1 | 3/2017 | Parlin et al. | |
| 2018/0112497 | A1 | 4/2018 | Pendleton et al. | |

* cited by examiner

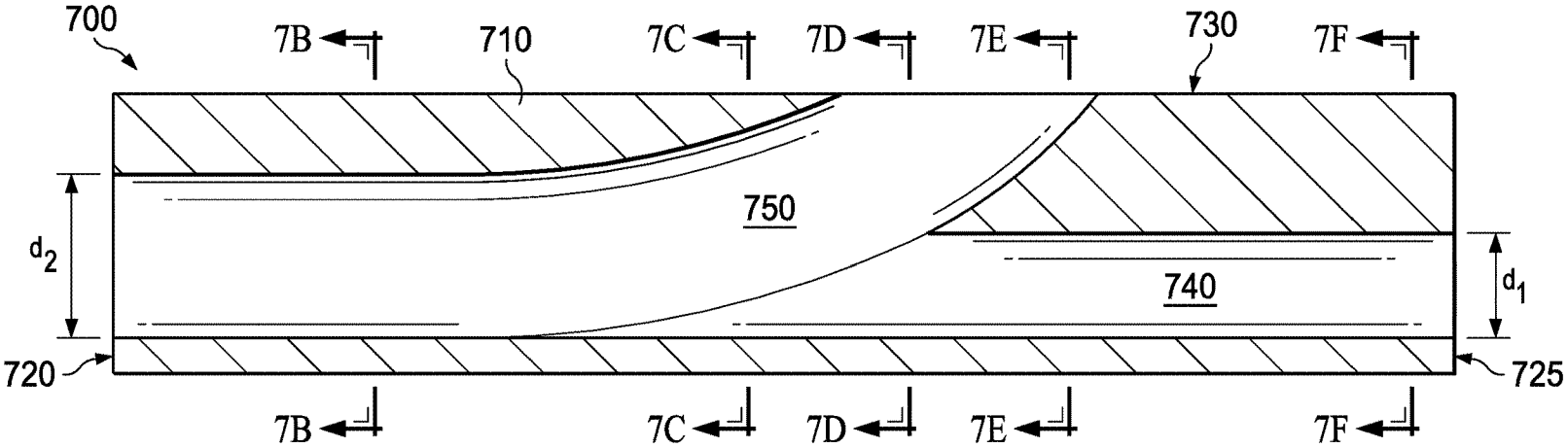
FIG. 7A
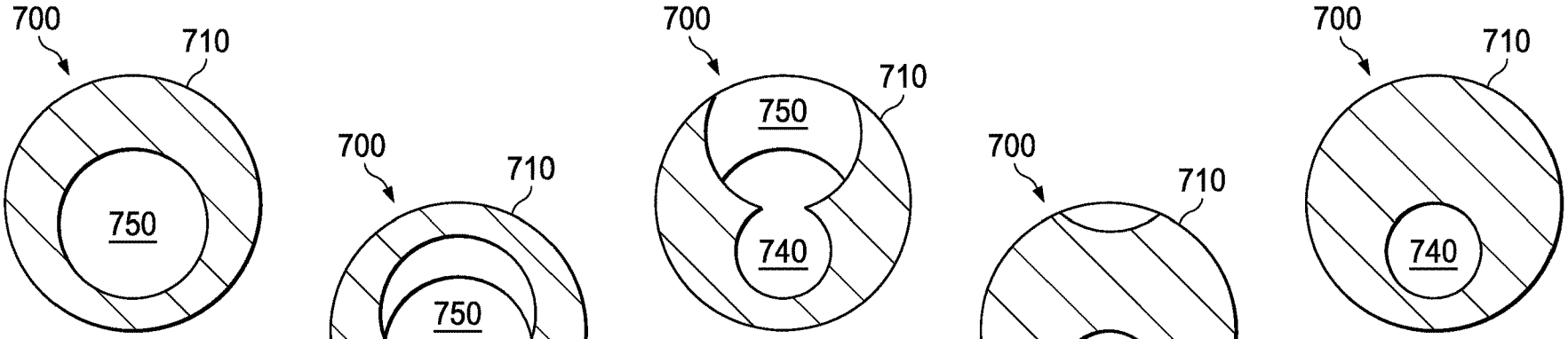
FIG. 7B
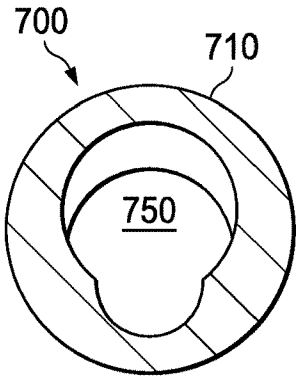
FIG. 7C
FIG. 7D
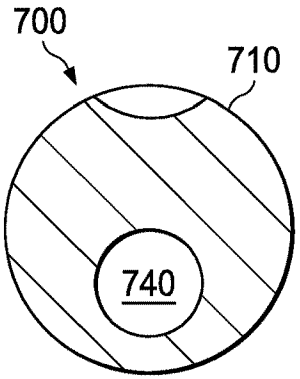
FIG. 7E
FIG. 7F

MULTILATERAL MULTISTAGE SYSTEM AND METHOD

CROSS-REFERENCE TO RELATED APPLICATION

This application claims the benefit of U.S. Provisional Application Ser. No. 62/757,941, filed on Nov. 9, 2018, and entitled "MULTILATERAL MULTISTAGE FRAC SYSTEM AND METHOD," commonly assigned with this application and incorporated herein by reference in its entirety.

BACKGROUND

A variety of selective borehole pressure operations require pressure isolation to selectively treat specific areas of the wellbore. One such selective borehole pressure operation is horizontal multistage hydraulic fracturing ("frac" or "fracking"), where a sequence of balls or plugs are deployed to a series of respective, paired seats that are installed or staged in a premeditated orientation inside a well. Pressure is applied to each landed ball or plug to force fluid into the formation through an access location within the casing for each stage. At the end of the treatment, the deployed ball/plugs are milled out or dissolved before production commences.

In multilateral wells, the multistage stimulation treatments are performed inside multiple lateral wellbores. Efficient access to all lateral wellbores is critical to complete successful pressure stimulation treatment. What is needed in the art, are improved processes and devices for multistage stimulation treatments.

BRIEF DESCRIPTION

Reference is now made to the following descriptions taken in conjunction with the accompanying drawings, in which:

FIGS. 7A-7L illustrate various different cross-sectional views of one embodiment of a downhole deflector assembly designed, manufactured and operated according to the disclosure.

DETAILED DESCRIPTION

Figure 1:
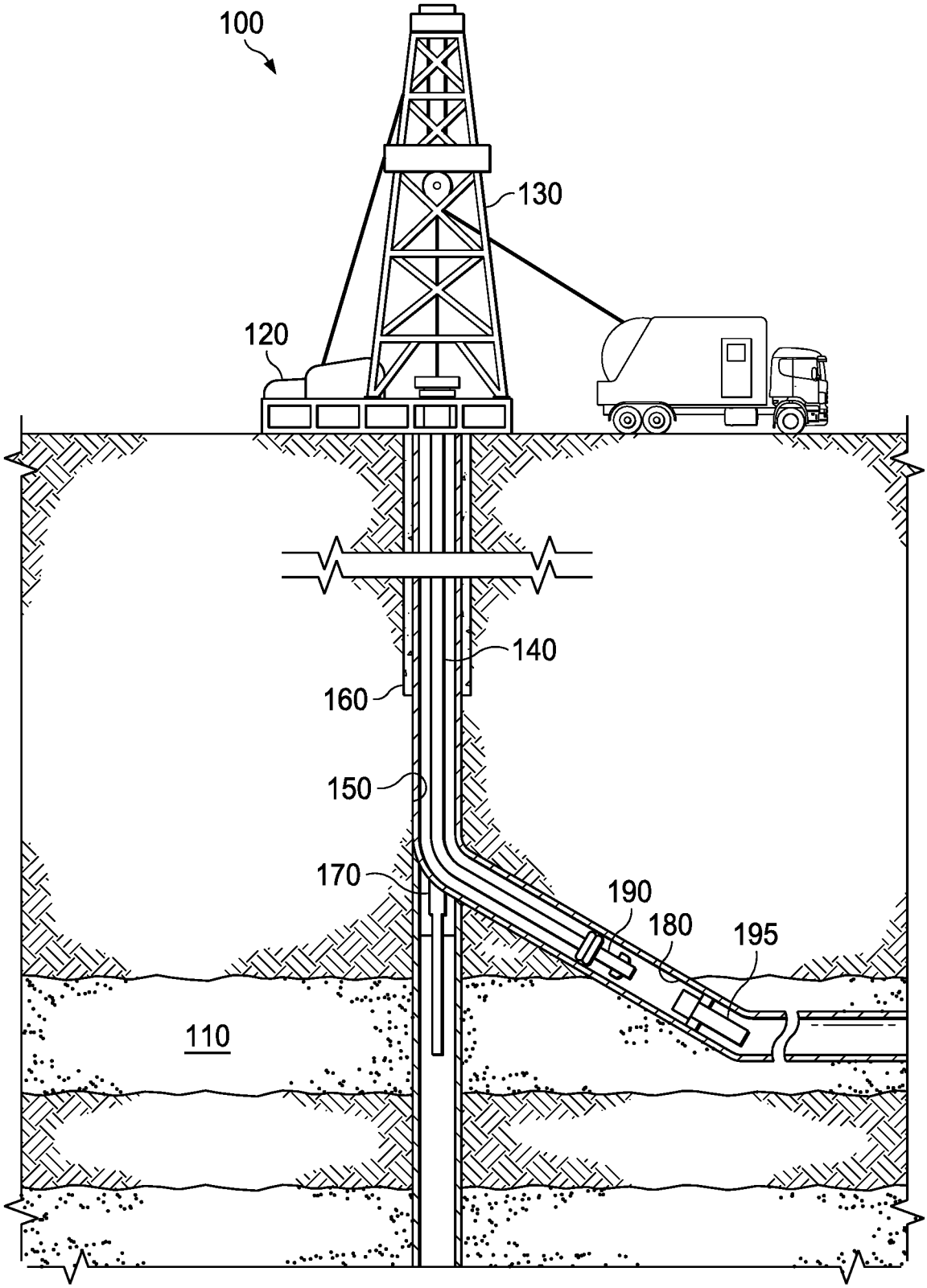
FIG. 1 illustrates a schematic view of a well system designed and manufactured according to one or more embodiments disclosed herein.

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness.

The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," or other like terms shall be construed as generally toward the surface of the well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

FIG. 1 is a schematic view of a well system 100 designed and manufactured according to one or more embodiments disclosed herein. The well system 100 includes a rig 120 positioned over an oil and gas formation 110 located below the earth's surface 115. The rig 120, in one embodiment, has a hoisting apparatus 130 for raising and lowering a conveyance, such as the coiled tubing 140. Although a land-based rig 120 is illustrated in FIG. 1, the scope of this disclosure is not thereby limited, and thus could potentially apply to offshore applications. The teachings of this disclosure may also be applied to other land-based well systems and/or offshore well systems different from that illustrated.

As shown, a main wellbore 150 has been drilled through the various earth strata, including the formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as "liner" and may be made of any material, such as steel or composite material and may be segmented or continuous, such as coiled tubing.

A downhole deflector assembly 170 according to the present disclosure may be positioned at a desired intersection between the main wellbore 150 and a lateral wellbore 180. As those skilled in the art will appreciate, the downhole deflector assembly 170 is configured to selectively deflect an intervention tool 190 designed and manufactured according to the disclosure from the main wellbore 150 to the lateral wellbore 180. For example, the downhole deflector assembly 170 could selectively deflect the intervention tool 190, which could comprise a fracturing tool, toward a lockdown sub 195 in the lateral wellbore 180. The intervention tool 190, in accordance with one embodiment of the disclosure, includes a radial outer housing, and an expansion member coupled proximate an outer surface of the radial outer housing. The intervention tool 190 according to this embodiment further includes a sliding sleeve positioned along an interior surface of the radial outer housing and engageable with the expansion member, the sleeve including a collection of slots or catches configured to move the expansion member between a radially retracted position when the sliding sleeve is in a first linear position and a radially expanded position when the sliding sleeve is in a second linear position.

Figure 2A:
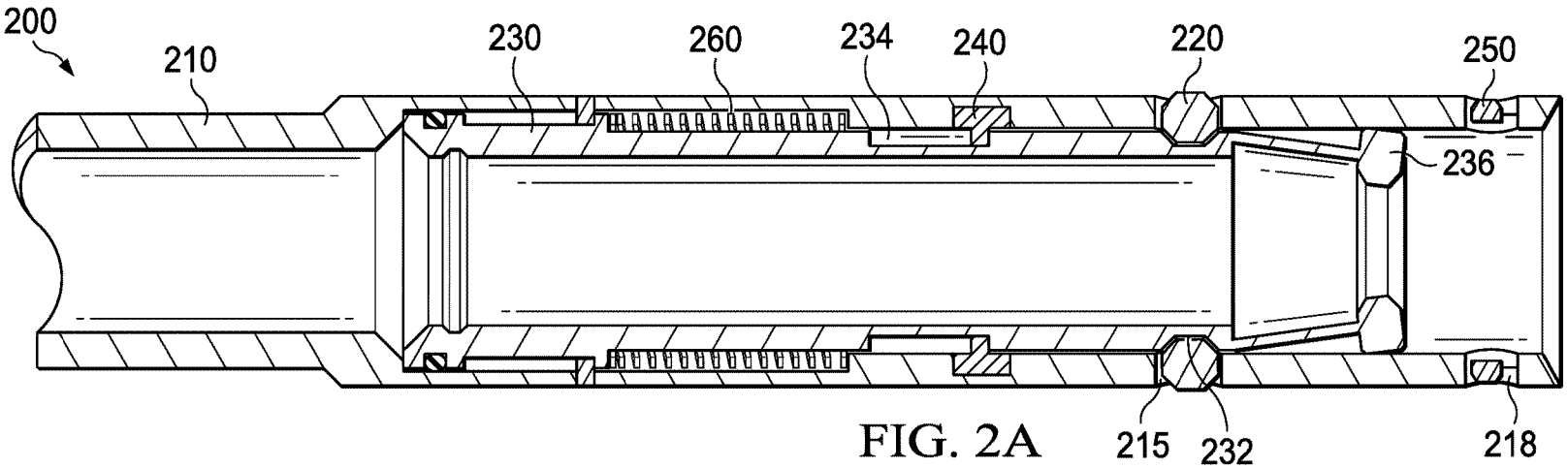
FIG. 2A illustrates an enlarged cross-section view of an intervention tool designed and manufactured according to principles of the present disclosure.

Turning now to FIG. 2A, illustrated is an enlarged cross-section view of an intervention tool 200 designed and manufactured according to principles of the present disclosure. The intervention tool 200, in the illustrated embodiment, includes a radial outer housing 210. The radial outer housing 210, in accordance with one embodiment, comprises metal or a metal alloy, and forms an interior bore to flow fluid. Notwithstanding, other materials and configurations are within the scope of the present disclosure.

The intervention tool 200 additionally includes an expansion member 220 coupled proximate an outer surface of the radial outer housing 210. The expansion member 220, in the illustrated embodiment, is configured to move from a radially retracted position to a radially expanded position, as will be discussed in greater detail below. The expansion member 220, in the illustrated embodiment of FIG. 2A, is a collet C-ring positioned within an opening 215 in the radial outer housing 210. Accordingly, the expansion member 220 may expand outwardly when subjected to a radial outward force.

The intervention tool 200, in the illustrated embodiment of FIG. 2A, additionally includes a sliding sleeve 230 positioned along an interior surface of the radial outer housing 210. In accordance with the disclosure, the sliding sleeve 230 is configured (e.g., splined) to linearly slide within the radial outer housing 210 to engage the expansion member 220. For example, the sliding sleeve 230 may include a collection of raised features and/or troughs 232, such that when the sliding sleeve 230 linearly moves within the radial outer housing 210, the raised feature and/or troughs 232 cause the expansion member 220 to move between the radially retracted position and the radially expanded position, or vice versa.

In accordance with this embodiment, the sliding sleeve 230 additionally includes a collection of slots (e.g. continuous series of J-slots around the circumference of the sliding sleeve) or catches 234. The collection of slots or catches 234 are configured to engage one or more position pins 240 associated with the radial outer housing 210, and thus limit the linear movement or position of the sliding sleeve 230. For example, the collection of slots or catches 234 move the expansion member 220 between the radially retracted position when the sliding sleeve 230 is in a first linear position (e.g., as dictated by the position pins 240) and the radially expanded position when the sliding sleeve 230 is in a second linear position (e.g., as dictated by the position pins 240). In the illustrated embodiment of FIG. 2A, the one or more position pins 240 are coupled to and rotate about a radial recess 242 inside the outer housing 210. Other configurations are, however, within the scope of the disclosure.

Figure 2B:
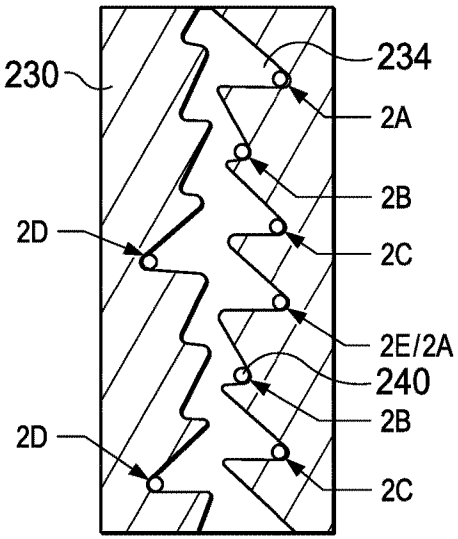
FIG. 2B illustrates one detailed example of the collection of slots or catches that might be used in the intervention tool illustrated in FIG. 2A.

Turning to FIG. 2B, illustrated is one detailed example for the collection of slots or catches 234. In the embodiment shown in FIG. 2B, the slots or catches 234 are a collection of continuous J-slots cut in the circumference of the sliding sleeve 230 that engage the one or more position pins 240. For example, according to this embodiment, the one or more J-slots include a first slot 2A configured to position the sliding sleeve 230 in a first (e.g., uphole) linear position and thus move the expansion member to a first radially retracted position, a second slot 2B configured to position the sliding sleeve 230 in a second (e.g., mid-hole) linear position and thus move the expansion member to a second radially expanded position, a third slot 2C configured to position the sliding sleeve in a third (e.g., uphole) linear position and thus move the expansion member to a third radially retracted position, and a fourth slot 2D configured to position the sliding sleeve in a fourth (e.g., downhole) linear position and thus move the expansion member to a fourth modified radially expanded position. In the illustrated embodiment of FIG. 2B, the first, second, third and fourth slots 2A, 2B, 2C, 2D could then repeat (e.g., as depicted by the 2E/2A slot in FIG. 2B), thereby providing four repeating linear positions.

In one specific embodiment, such as that shown in FIG. 2B, the first slot 2A and third slot 2C may be substantially similarly shaped. Accordingly, the sliding sleeve 230 may be in a substantially similar linear position, or identical linear position, when the position pin 240 is in the first slot 2A as when the position pin is in the third slot 2C. In the embodiment of FIG. 2B, the second slot 2B is positioned between the first slot 2A and the fourth slot 2D. Accordingly, when the position pin 240 is in the second slot 2B, the sliding sleeve 230 is linearly positioned at a location between where it would be located if the position pin 240 were in the first slot 2A or the fourth slot 2D.

Referring back to FIG. 2A, the sliding sleeve 230 additionally includes a catch 236. The catch 236, in this embodiment, extends radially inward from the sliding sleeve 230 for engaging a drop ball or plug. The catch 236, in the illustrated embodiment, is a ball catch finger collet. For example, the ball catch finger collet, in this embodiment, may be located proximate an end of the sliding sleeve 230 near the expansion member 220, which in the embodiment illustrated in FIG. 2A is a downhole end of the sliding sleeve 230. In other embodiments, the catch 236 may be located proximate an end of the sliding sleeve 230 distal the expansion member 220, which in this embodiment would be an uphole end of the sliding sleeve 230.

The intervention tool 200, in the embodiment of FIG. 2A, may additionally include a release tab 250. The release tab 250, in the illustrated embodiment, is at least partially enclosed within a slot 218 in the radial outer housing 210. In accordance with the embodiment of FIG. 2A, the catch 236 is movable to enter the slot 218 and engage the release tab 250. Accordingly, the release tab 250 and catch 236 are configured to removably affix the intervention tool 200 within another downhole tool, such as a lockdown sub during an intervention process.

The intervention tool 200 may additionally include a spring member 260. The spring member 260, in one embodiment, is positioned between a shoulder of the radial outer housing 210 and a shoulder of the sliding sleeve 230. Accordingly, the spring member 260 may assist in moving the expansion member 220 between the radially expanded position and the radially retracted position by assisting in the linear movement of the sliding sleeve 230. In the illustrated embodiment, the spring member 220 is in its extended state when the sliding sleeve 230 is in the first position, in its partially compressed state when the sliding sleeve 230 is in the second position, in its extended state when the sliding sleeve 230 is in the third position, and in the compressed state when the sliding sleeve 230 is in the fourth position.

Turning to FIGS. 3A-3F, illustrated is a method for operating the intervention tool 200 illustrated in FIGS. 2A and 2B. With initial reference to FIGS. 3A and 3F, the intervention tool 200 has been run in hole, and at this stage is positioned within wellbore casing 380. At this stage of operation, the spring member 260 keeps the position pin 240 in the first slot 3A, and thus maintains the sliding sleeve 230 in the first linear position. With the sliding sleeve 230 in the first linear position, the expansion member 220 remains in the radially retracted position. Accordingly, there is little issue with the expansion member 220 catching features in the wellbore casing 380 during deployment.

Figure 3A:
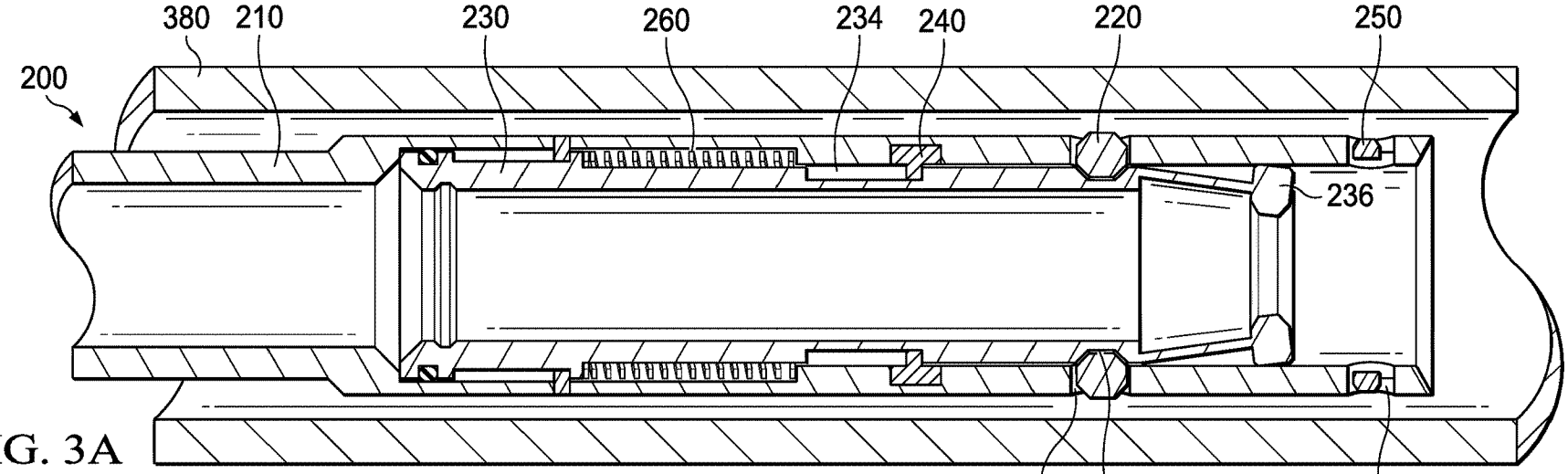
FIGS. 3A-3F illustrate a method for operating the intervention tool illustrated in FIGS. 2A and 2B.
Figure 3B:
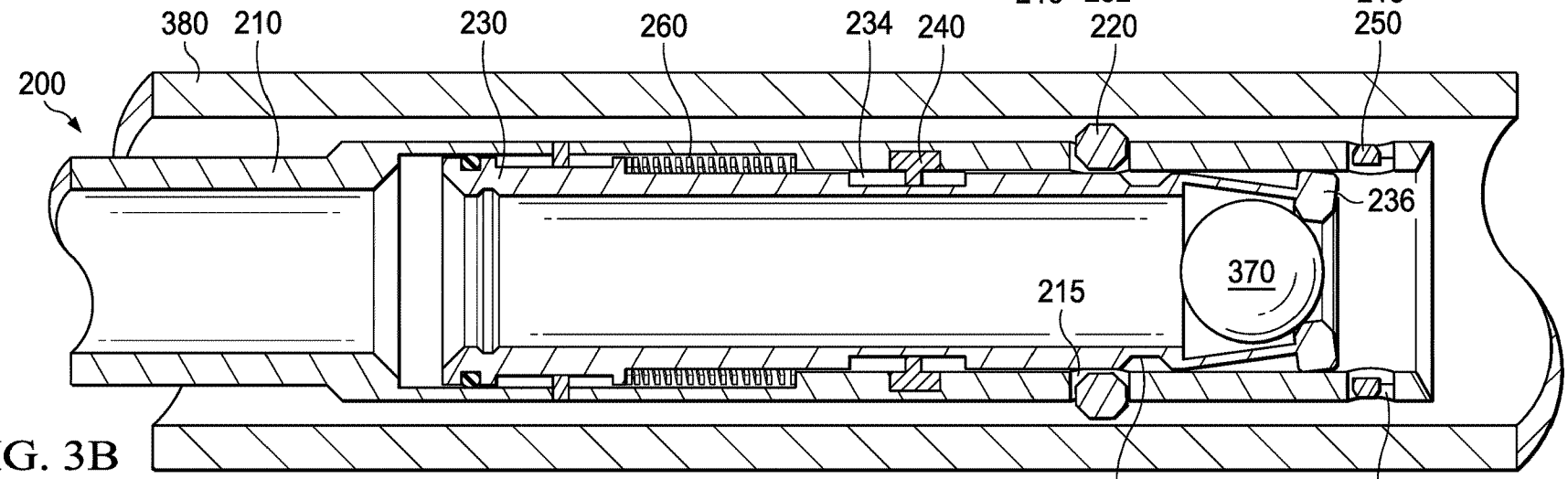
Figure 3C:
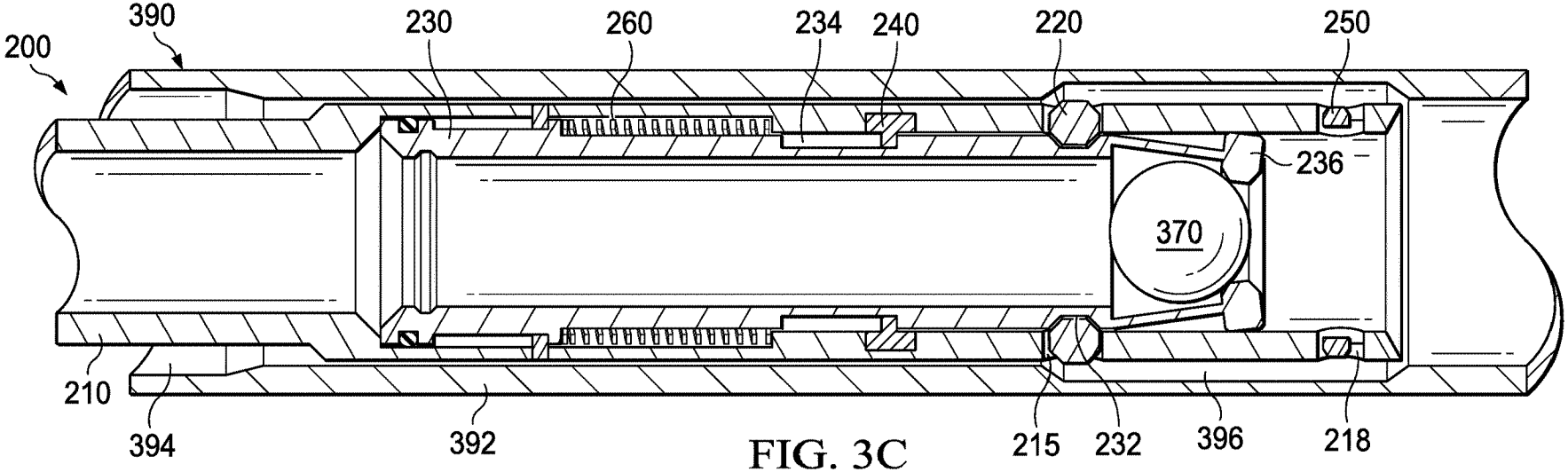
Figure 3D:
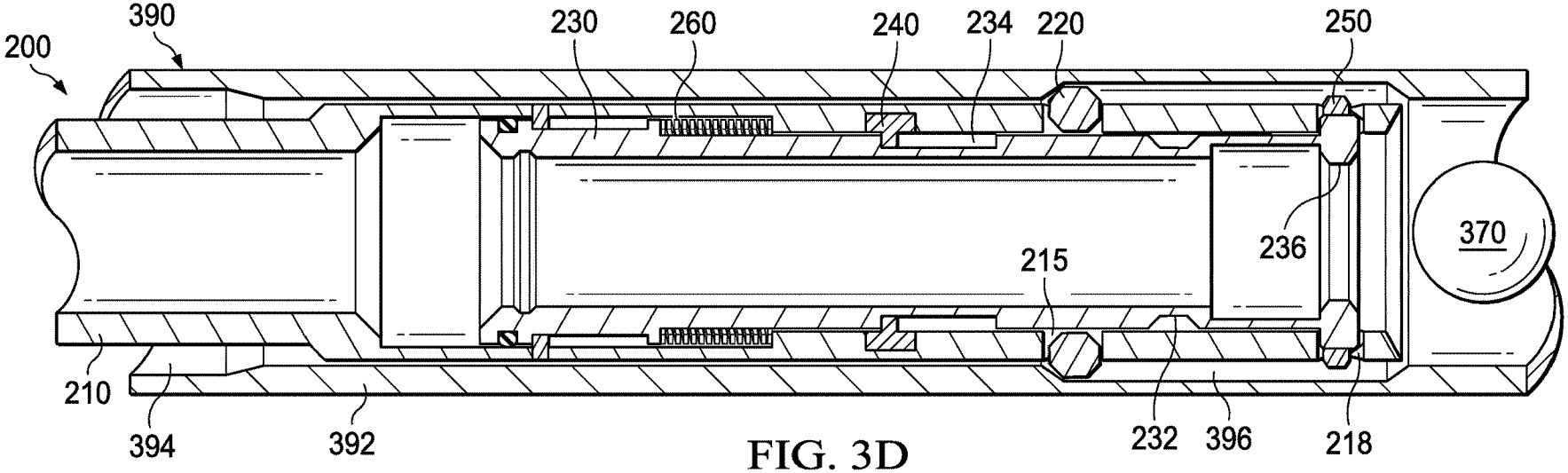
Figure 3E:
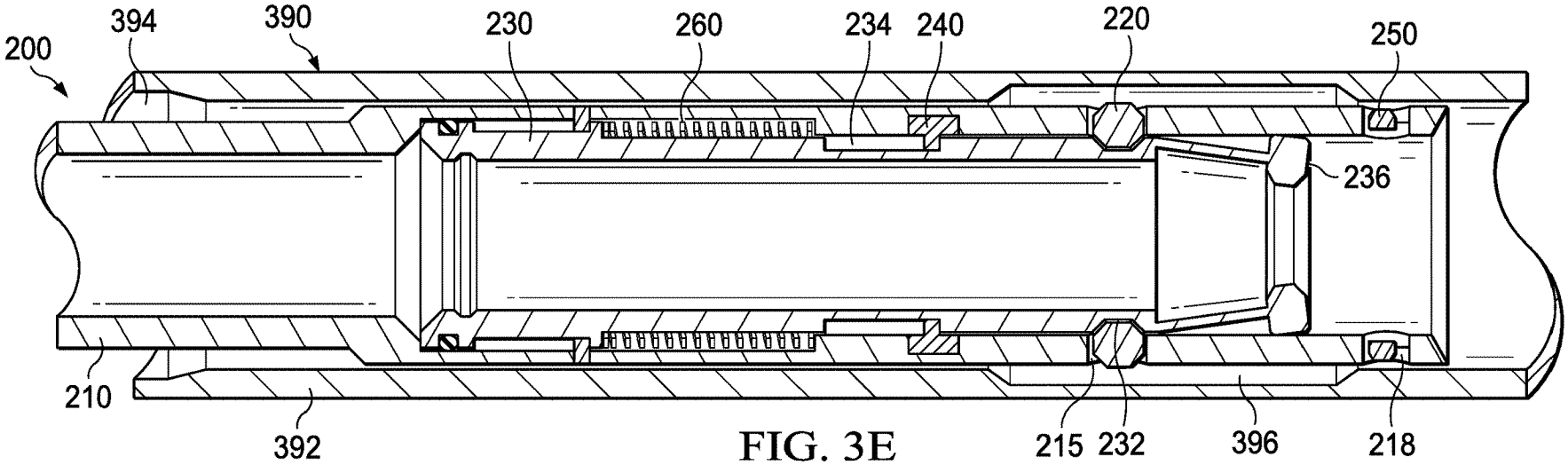
Figure 3F:
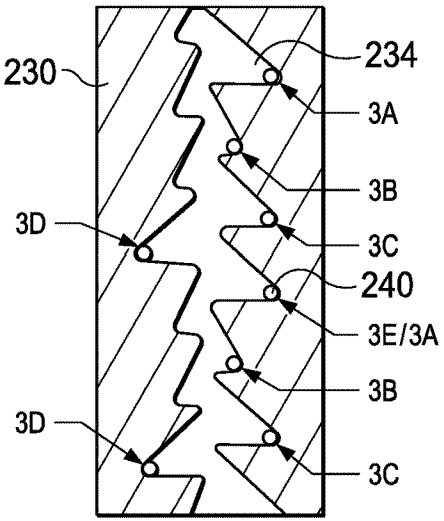

Turning to FIGS. 3B and 3F, illustrated is the intervention tool 200 of FIG. 3A after positioning it at the desired depth and deploying a drop ball or plug 370. As illustrated, the drop ball or plug 370 may seat against the catches 236 of the sliding sleeve 230. With the drop ball or plug 370 seat against the catches 236, the intervention tool may be subjected to a first pressure up/down sequence. In accordance with one embodiment of the disclosure, the first pressure up/down sequence cycles the position pin 240 from the first slot 3A to the second slot 3B, which in turn slides the sliding sleeve 230 to the second linear position, as shown in FIG. 3B. Similarly, the raised features and/or troughs 232 in the sliding sleeve 230 move the expansion member 220 from the radially retracted position it held in FIG. 3A, to the radially expanded position it holds in FIG. 3B.

The drop ball or plug 370 may comprise many different materials, shapes and sizes and remain within the scope of the disclosure. The drop ball or plug 370, should however comprise a material, shape and size conducive for seating with the catches 236, such that the intervention tool 200 may be appropriately subjected to one or more pressure up/down sequences. In the illustrated embodiment of FIG. 3B, the drop ball or plug 370 could be a dissolvable drop ball. Those skilled in the art understand the various different types of materials that might be used for the dissolvable drop ball, and when and if using a dissolvable drop ball is warranted.

In accordance with one embodiment, the position pin 240 and one or more slots or catches 234 are configured to keep the sliding sleeve 230 in a fixed position (e.g., the second linear position in the embodiment of FIG. 3B) without continuous fluid pressure on the drop ball or plug 370. Accordingly, the expansion member 220 may also be kept in a fixed position (e.g., radially expanded position in FIG. 3B) without continuous fluid pressure on the drop ball or plug 370.

As will be discussed in greater detail below, the expansion member 220 may be positioned in the radially expanded position shown in FIG. 3B to deflect the intervention tool 200 into a lateral wellbore. For example, in one situation the intervention tool 200 with the radially expanded expansion member 220 might encounter a downhole deflector assembly, which collectively would deflect and re-route the intervention tool 200 into the lateral wellbore. Such a deflection and/or rerouting is selective, as the intervention tool 200 likely would remain within the main wellbore if the expansion member 220 was in the radially retracted position.

Turning to FIGS. 3C and 3F, illustrated is the intervention tool 200 of FIG. 3B after subjecting the drop ball or plug 370 to a second pressure up/down sequence. The second pressure up/down sequence cycles the position pin 240 from the second slot 3B to the third slot 3C, which in turn slides the sliding sleeve 230 to the third linear position, as shown in FIG. 3C. As indicated above, the third linear position may be substantially similar to, or even identical to, the first linear position. Nevertheless, the raised features and/or troughs 232 in the sliding sleeve 230 now move the expansion member 220 from the radially expanded position it held in FIG. 3B, to the radially retracted position it holds in FIG. 3C.

Similarly, the intervention tool 200, with the expansion member 220 in the radially retracted position, has been positioned proximate a lockdown sub 390, as might be used as part of a lateral drop off sub. The lockdown sub 390, in the illustrated embodiment of FIG. 3C, includes a tubular housing 392. The tubular housing 392 may comprise metal, a metal alloy, or another well-know or hereafter discovered downhole material and remain with the scope of the disclosure. Positioned within the tubular housing 392 is a lockdown recess funnel profile 394. The lockdown recess funnel profile 394, in the illustrate embodiment, is located proximate an uphole end of the lockdown sub 390, and in one embodiment is configured to funnel the intervention tool 200 to an interior of the lockdown sub 390. Accordingly, the lockdown recess funnel profile 394 may start with a larger inner diameter and gradually reduce in diameter until it reaches the unaltered diameter of the tubular housing 392.

The tubular housing 392 may additionally include a lockdown recess catch profile 396. The lockdown recess catch profile 396, in the illustrated embodiment of FIG. 3C, is positioned downhole of the lockdown recess funnel profile 394. In one particular embodiment, the lockdown recess catch profile 396 is located proximate a downhole end of the lockdown sub 390. The lockdown recess catch profile 396, in the illustrated embodiment, has a greater diameter than the unaltered diameter of the tubular housing 392. As will be readily apparent below, the lockdown recess catch profile 396 is configured to engage the expansion member 220 when it is in its radially expanded position, and thus lock the intervention tool 200 with the lockdown sub 390.

Turning to FIGS. 3D and 3F, illustrated is the intervention tool 200 of FIG. 3C after subjecting the drop ball or plug 370 to a third pressure up/down sequence. The third pressure up/down sequence cycles the position pin 240 from the third slot 3C to the fourth slot 3D, which in turn slides the sliding sleeve 230 to the fourth linear position, as shown in FIG. 3D. The raised features and/or troughs 232 in the sliding sleeve 230 now move the expansion member 220 from the radially retracted position it held in FIG. 3C, to the radially expanded position it holds in FIG. 3D. In this position, the expansion member 220 engages with the lockdown recess catch profile 396, and thus fixes the intervention tool 200 to the lockdown sub 390.

Additionally, the catch 236 in the sliding sleeve 230 may move into the slot 218 in the radial outer housing 210, and thus engage the release tab 250. With the catch 236 radially extended into the slot 218, the sliding sleeve 230 is held in the fourth linear position. In the particular embodiment of FIG. 3D, if the catch 236 were not in the slot 218, the spring member 260 would return the sliding sleeve 230 to the first linear position. Additionally, with the catch 236 radially extended into the slot 218, the drop ball or plug 370 is allowed to pass through the intervention tool 200 and flow downhole.

Turning to FIGS. 3E and 3F, illustrated is the intervention tool 200 of FIG. 3D after pushing the intervention tool 200 downhole within the lockdown sub 390. In doing so, the release tab 250 is depressed by the back side of the lockdown recess catch profile 396, which in turn pushes the catch 236 out of the slot 218. With the catch 236 out of the slot 218, and no drop ball or plug 370 to pressure down on the sliding sleeve 230 to keep it in place, the spring member 260 returns the sliding sleeve 230 to the first linear position. Accordingly, the intervention tool 200 has been returned to the run-in hole position, and thus may be withdrawn if desired.

Figure 4A:
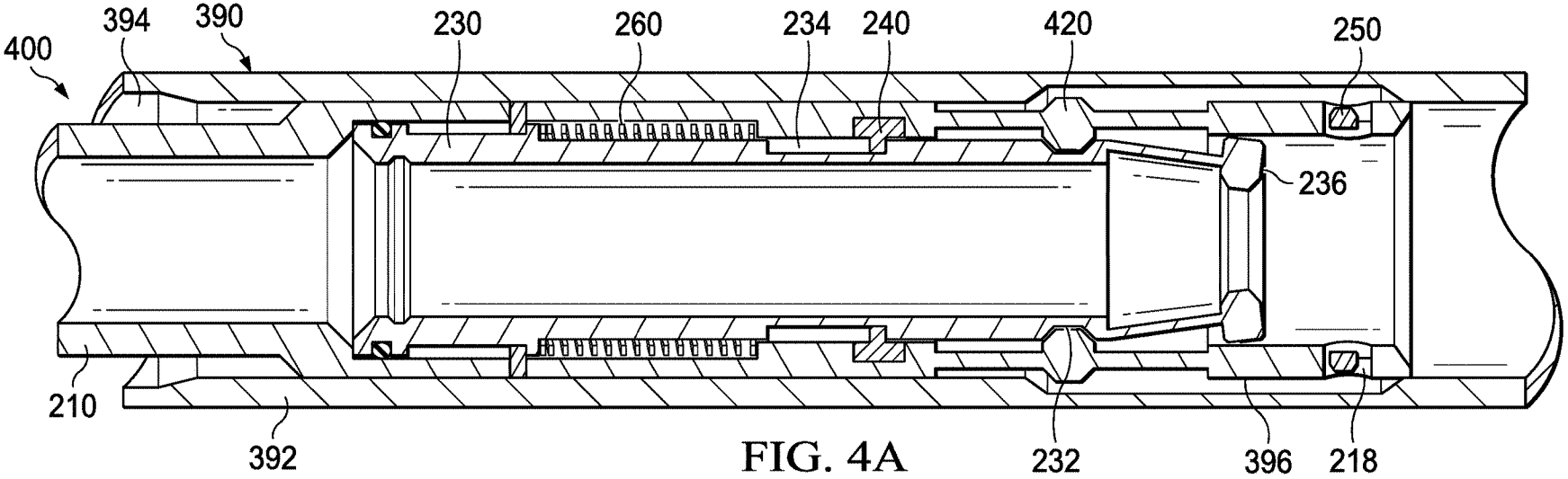
FIGS. 4A-6B illustrate alternative embodiments of intervention tools designed and manufactured according to the disclosure.
Figure 4B:
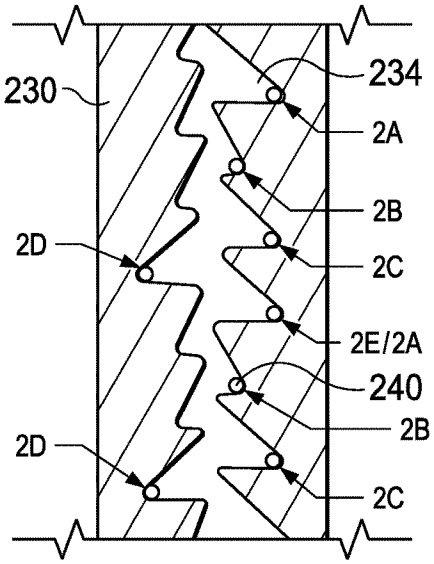

Turning to FIGS. 4A and 4B, illustrated is an alternative embodiment of an intervention tool 400 designed and manufactured according to the disclosure. The intervention tool 400 is similar in many respects to the intervention tool 200 described above with regard to FIGS. 2A, 2B and 3A-3F. Accordingly, like reference numbers may be used to indicate similar, if not identical, features. The intervention tool 400 differs, for the most part, from the intervention tool 200, in that the intervention tool 400 includes an expansion member 420 that is formed from at least a portion of the radial outer housing 210. Accordingly, wherein the expansion member 220 was a stand-alone feature, the expansion member 420 is not. Those skilled in the art understand that the intervention tool 400 would operate in much the same manner as the intervention tool 200, for example as shown and described with regard to FIGS. 3A-3F.

Figure 5A:
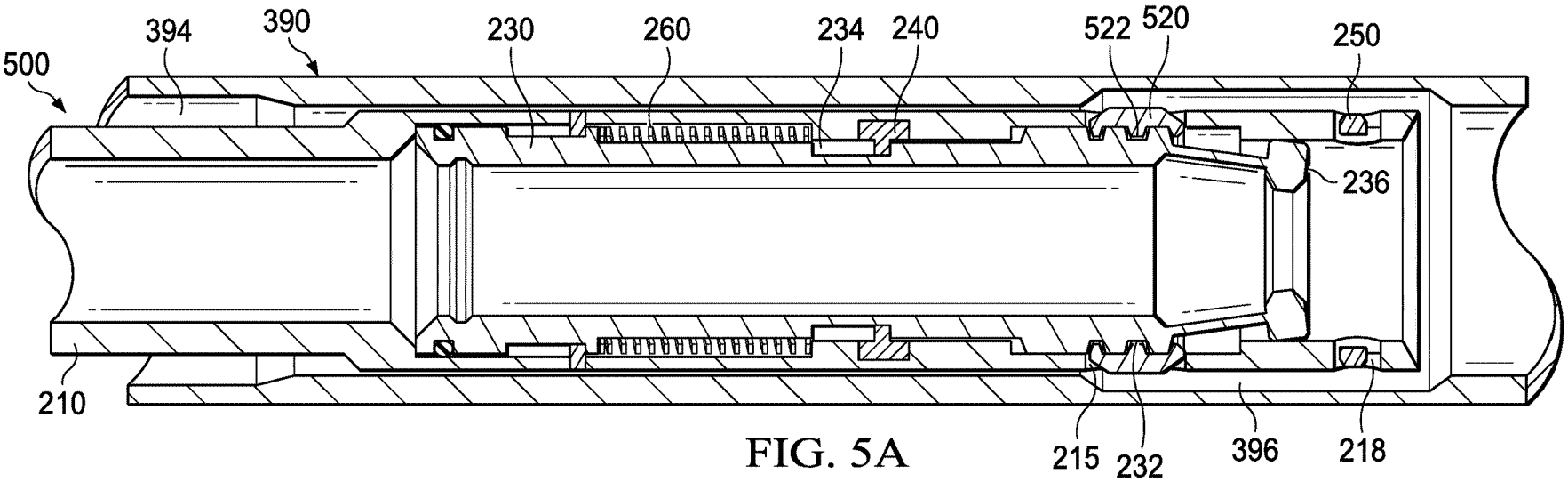
Figure 5B:
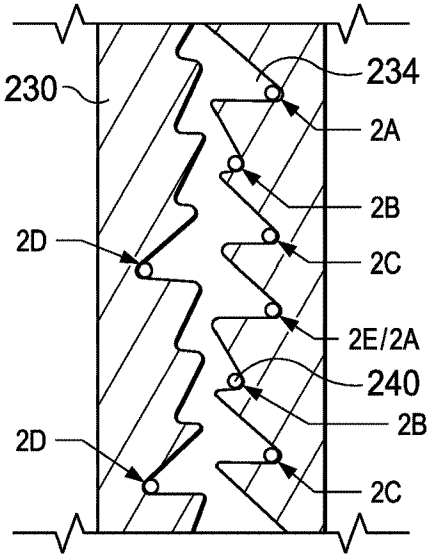

Turning to FIGS. 5A and 5B, illustrated is an alternative embodiment of an intervention tool 500 designed and manufactured according to the disclosure. The intervention tool 500 is similar in many respects to the intervention tool 200 described above with regard to FIGS. 2A, 2B and 3A-3F. Accordingly, like reference numbers may be used to indicate similar, if not identical, features. The intervention tool 500 differs, for the most part, from the intervention tool 200, in that the intervention tool 500 employs a collet barrel ring 520 as its expansion member. The collet barrel ring 520, in the illustrated embodiment of FIGS. 5A and 5B, includes multiple raised feature and/or troughs 522 that correspond with multiple raised features and/or troughs 232 in the sliding sleeve 230. Those skilled in the art understand that the intervention tool 500 would operate in much the same manner as the intervention tool 200, for example as shown and described with regard to FIGS. 3A-3F.

Figure 6A:
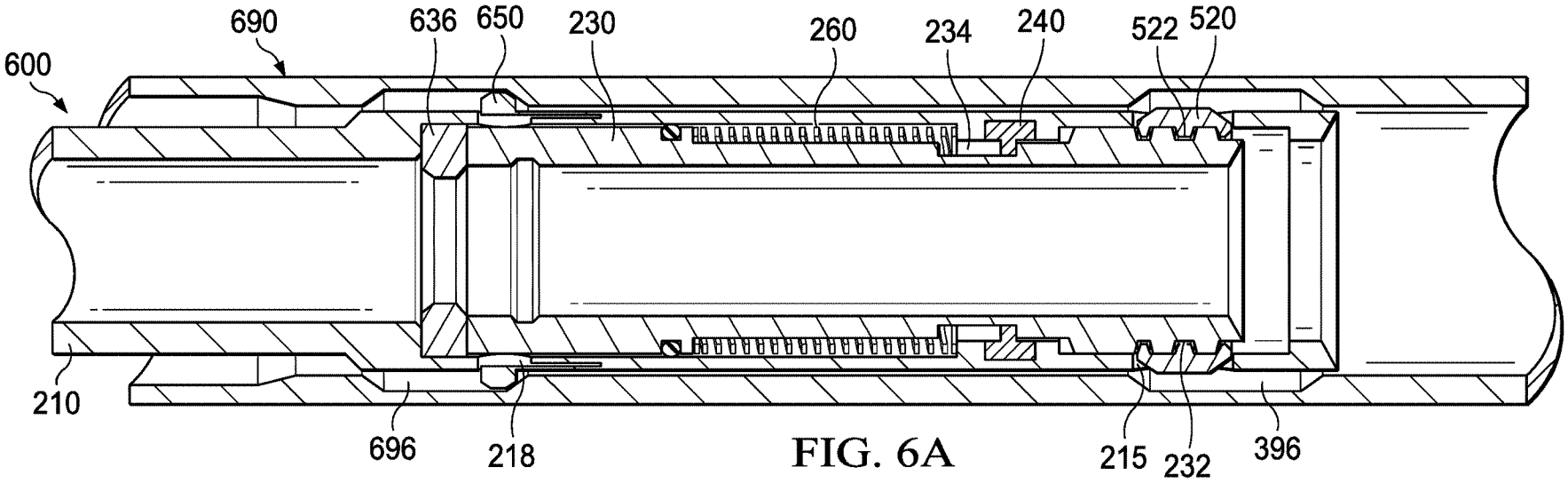
Figure 6B:
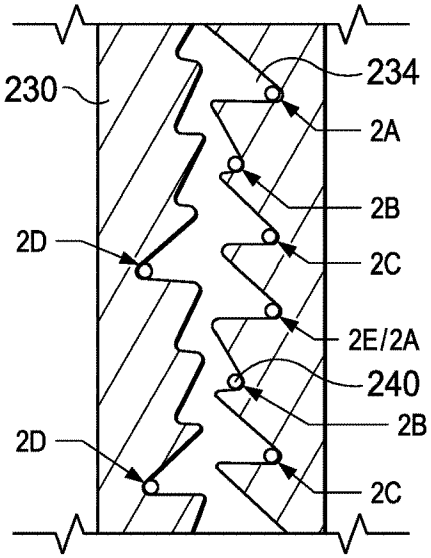
Figure 7G:
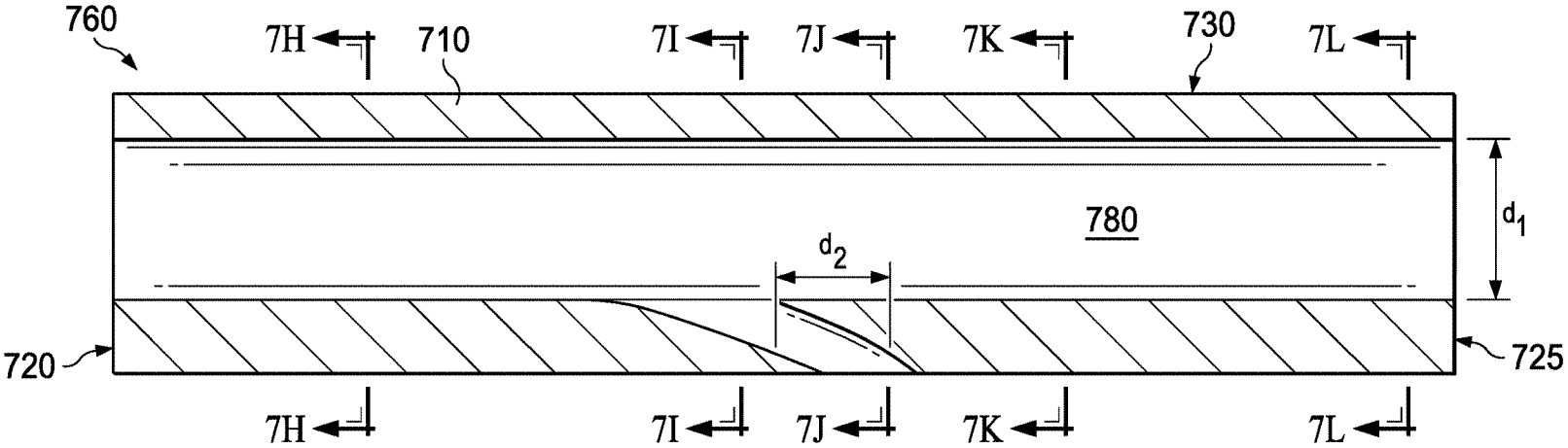
Figure 7L:
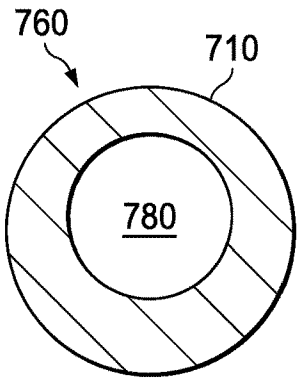
Figure 7K:
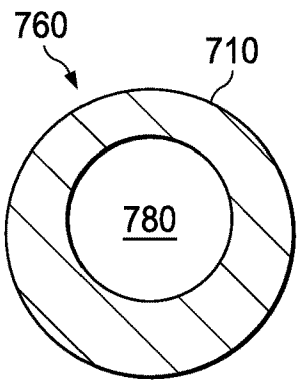
Figure 7J:
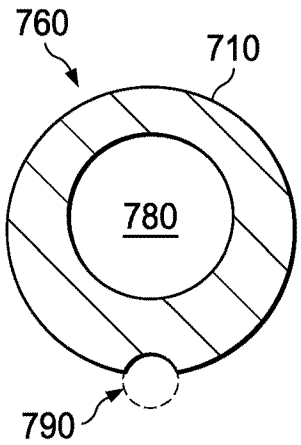
Figure 7I:
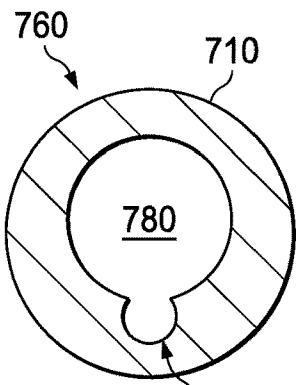
Figure 7H:
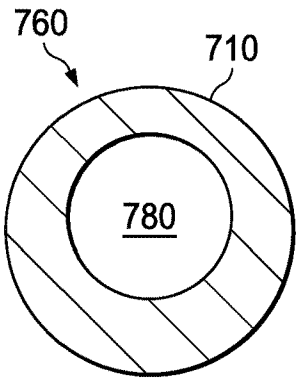

Turning to FIGS. 6A and 6B, illustrated is an alternative embodiment of an intervention tool 600 designed and manufactured according to the disclosure. The intervention tool 600 is similar in many respects to the intervention tool 500 described above with regard to FIGS. 5A and 5B. Accordingly, like reference numbers may be used to indicate similar, if not identical, features. The intervention tool 600 differs, for the most part, from the intervention tool 500, in that the intervention tool 600 employs a ball catch seat ring 636 to seat with the drop ball or plug. Additionally, the ball catch seat ring 636 does not form a portion of the sliding sleeve 230, but is a separate feature. Likewise, the ball catch seat ring 636 is located proximate an end of the sliding sleeve 230 distal the expansion member 520 (e.g., uphole end), as opposed to proximate an end of the sliding sleeve 230 proximate the expansion member 520 (e.g., downhole end), as shown in FIG. 5A. Notwithstanding the foregoing, other embodiments may exist wherein the ball catch seat ring 636 is used, but it is positioned proximate the expansion member 520.

Further to this embodiment, a release tab 650 is positioned proximate an end of the sliding sleeve 230 distal the expansion member 520 (e.g., uphole end), as opposed to proximate an end of the sliding sleeve 230 proximate the expansion member 520 (e.g., downhole end), as shown in FIG. 5A. Additionally, lockdown sub 690 includes a lockdown recess release profile 696. The lockdown recess release profile 696, in the illustrated embodiment of FIG. 6A, is configured to engage the release tab 650 when it is in its radially expanded position, and thus provide a means for resetting the intervention tool 600. Those skilled in the art understand that the intervention tool 600 would operate in much the same manner as the intervention tool 200, for example as shown and described with regard to FIGS. 3A-3F.

Turning now to FIGS. 7A-7F, illustrated are various different cross-sectional views of one embodiment of a downhole deflector assembly 700 designed, manufactured and operated according to the disclosure. The downhole deflector assembly 700 includes a housing 710. The housing 710, in one embodiment, is a tubular housing comprising metal, a metal alloy, or another semi-rigid or rigid downhole material. The housing 710 is defined by a first end 720, a second end 725, and one or more longitudinal sidewalls 730. In those embodiments wherein the housing 710 defines a circular tubular member, such as shown in FIGS. 7A-7F, the housing 710 would have only a single longitudinal sidewall 730. However, if the housing 710 were to define a square tubular member, the housing 710 would have four longitudinal sidewalls 730. In accordance with one embodiment of the disclosure, the first end 720 is an uphole end, and the second end is a downhole end 725.

The downhole deflector assembly 700 additionally includes a first opening 740 extending entirely between the first end 720 and the second end 725. The downhole deflector assembly 700 additionally includes a second opening 750 extending from the first end 720 and exiting the longitudinal sidewall 730 of the housing 710. In the illustrated embodiment of FIGS. 7A-7F, a surface of the second opening 750 proximate the first end 720 is coplanar with a surface of the first opening 740 proximate the second end 725. Accordingly, in this embodiment, a centerline of the first opening 740 and a centerline of the second opening 750 are offset from one another.

In accordance with the disclosure, a cross-sectional area of the first opening 740 is different than a cross-sectional area of the second opening 750. In those instances, wherein the first opening 740 is a circular opening having a first diameter ($d_1$) and the second opening 750 is a circular opening having the second diameter ($d_2$), the second diameter ($d_2$) is different from the first diameter ($d_1$). In the illustrated embodiment of FIGS. 7A-7F, the downhole deflector assembly 700 is configured for use with a second lateral wellbore that is gravitationally above the main lateral wellbore. In accordance with this embodiment, the second diameter ($d_2$) would be greater than the first diameter ($d_1$). For example, in one embodiment, the second diameter ($d_2$) might be at least 10% greater than the first diameter ($d_1$). In yet another embodiment, the second diameter ($d_2$) might be at least 25% greater than the first diameter ($d_1$), and in yet even another embodiment the second diameter ($d_2$) might be at least 50% greater than the first diameter ($d_1$).

A deflector assembly, such as the deflector assembly 700, may be used in conjunction with the above-discussed intervention tool to selectively deflect the intervention tool into one of a main wellbore or a lateral wellbore. For instance, the deflector assembly 700 could be placed at a junction between a main wellbore and one or more lateral wellbores. In this scenario, if the main wellbore were aligned with the first opening 740 of the deflector assembly 700 and the lateral wellbore were aligned with the second opening 750 of the deflector assembly 700, the intervention tool would follow the first opening 740 and thus stay within the main wellbore if the expansion member were in the radially retracted position. However, if the expansion member of the intervention tool were in a radially expanded position, the intervention tool would no longer fit within the first opening 740 and thus would be forced to follow the second (e.g., larger) opening 750 and thus deflect into the lateral wellbore. The ability to selectively choose which wellbore an intervention tool will follow is particularly helpful when performing a fracturing process on or more of the main wellbore and lateral wellbores, among other intervention processes.

Turning briefly to FIGS. 7G-7L, illustrated are various different cross-sectional views of an alternative embodiment of a downhole deflector assembly 760 designed, manufactured and operated according to the disclosure. The downhole deflector assembly 760 is similar in many respects to the downhole deflector assembly 700. Accordingly, like reference numbers have been used to indicate similar, if not identical, features. The downhole deflector assembly 760, differs for the most part, from the downhole deflector assembly 700 in that it is configured for use with a second lateral wellbore that is gravitationally below the main lateral wellbore. According to the embodiment of FIGS. 7G-7L, the downhole deflector assembly 760 includes a first opening 780 extending entirely between the first end 720 and the second end 725. The downhole deflector assembly 760 additionally includes a second opening 790 extending from the first end 720 and exiting the longitudinal sidewall 730 of the housing 710. In the illustrated embodiment of FIGS. 7A-7F, a surface of the first opening 780 proximate the first end 720 is coplanar with a surface of the first second opening 790 proximate the first end 720. Accordingly, in this embodiment, a centerline of the first opening 780 and a centerline of the second opening 790 are offset from one another.

In accordance with this embodiment of the disclosure, a cross-sectional area of the first opening 780 is larger than a cross-sectional area of the second opening 790. In those instances wherein the first opening 780 is a circular opening having a first diameter ($d_1$) and the second opening 790 is a circular opening having the second diameter ($d_2$), the first diameter ($d_1$) is larger than the second diameter ($d_2$). For example, in one embodiment, the first diameter ($d_1$) might be at least 10% greater than the second diameter ($d_2$). In yet another embodiment, the first diameter ($d_1$) might be at least 25% greater than the second diameter ($d_2$), and in yet even another embodiment the first diameter ($d_1$) might be at least 50% greater than the second diameter ($d_2$).

Turning to FIGS. 8-16, illustrated is a method for fracturing multiple lateral wellbores in a well system 800 according to the disclosure. The well system 800 illustrated in FIG. 8 includes a parent wellbore 810, including casing 820 and cement 825. The well system 800 additionally includes a first lateral wellbore 830 (e.g., sometimes referred to as the main wellbore), and a second lateral wellbore 840. Positioned within the first lateral wellbore 830 is a first lateral (e.g., lower) completion 850, including a toe sub 855. Coupled to the first lateral completion 850 is an anchor hanger 860 (e.g., placed in the wellbore casing 820), the anchor hanger 860 having an orientation feature 865.

Positioned within the second lateral wellbore 840 is a second lateral (e.g., upper) completion 870. The second lateral completion 870, in the illustrated embodiment of FIG. 8, includes a frac sleeve 875, swell packers 880, and a liner sub 885. The liner sub 885, in the illustrated embodiment, includes a lockdown sub 890 designed and manufactured according to the disclosure. The lockdown sub 890 may be similar to the lockdown subs 390, 690 discussed above with regard to FIGS. 3C-3E and 4A-6A, among other lockdown subs designed and manufactured according to the disclosure. Those skilled in the art understand how to arrive at the well system 800 illustrated in FIG. 8, thus additional detail is not warranted.

Figure 8:
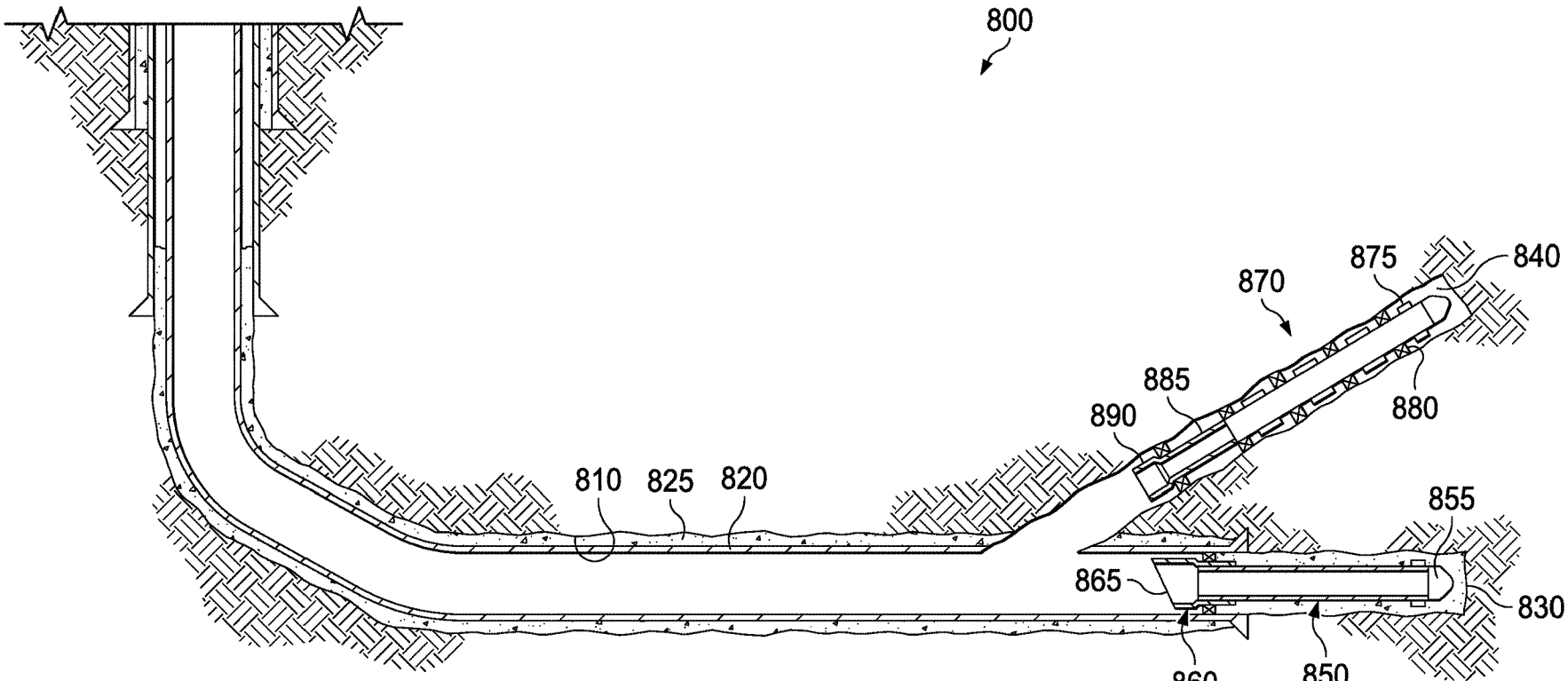
FIGS. 8-16 illustrate a method for fracturing multiple lateral wellbores of a well system according to the disclosure.
Figure 9:
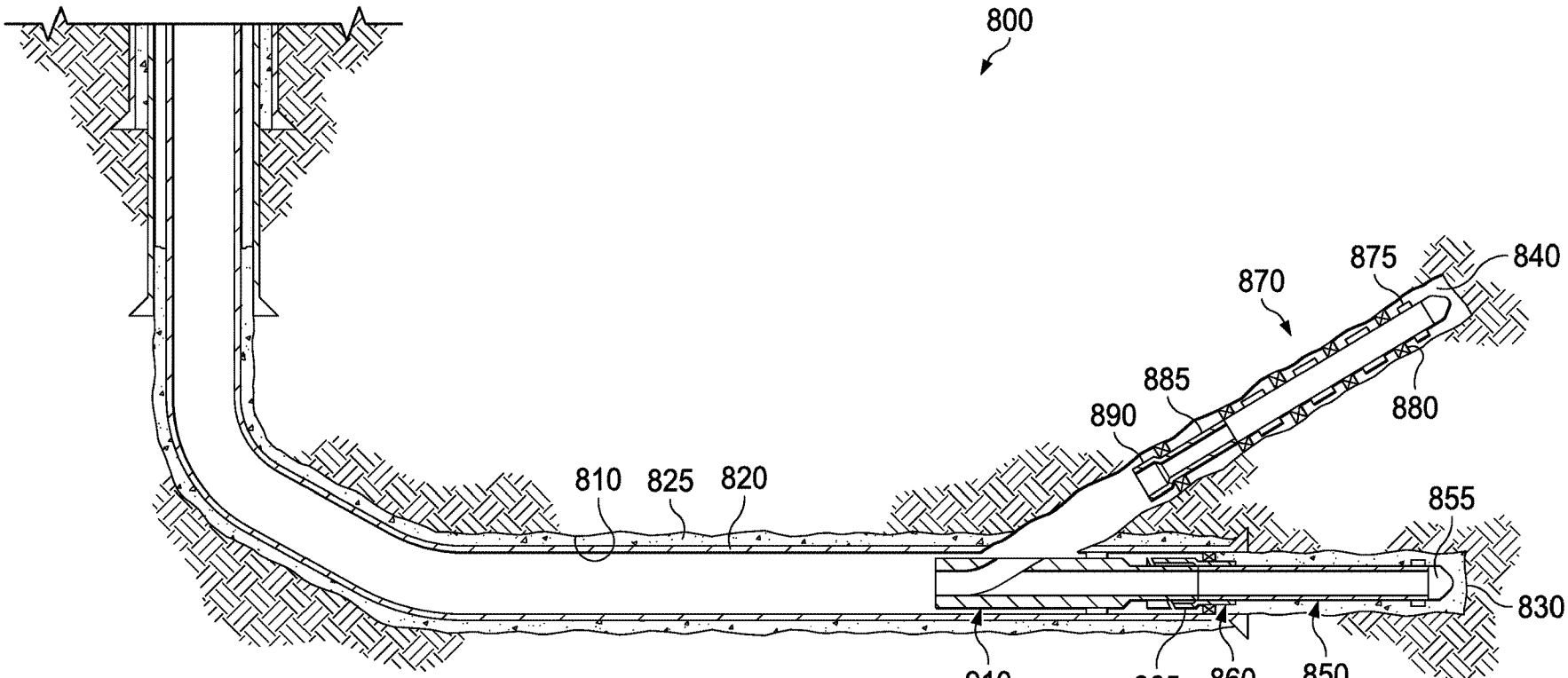

Turning to FIG. 9, illustrated is the well system 800 of FIG. 8 after positioning downhole a downhole deflector assembly 910 that has been designed and manufactured according to the disclosure. The downhole deflector assembly 910, in one embodiment, is similar to the downhole deflector assembly 700 illustrated and described with respect to FIGS. 7A-7F. In accordance with the embodiment of FIG. 9, the downhole deflector assembly 910 includes a housing defined by a first end, a second end, and one or more longitudinal sidewalls, and further includes a first smaller opening extending entirely between the first end and the second end, and a second larger opening extending from the first end and exiting the longitudinal sidewall.

In the embodiment of FIG. 9, the downhole deflector assembly 910 is engaged with the anchor hanger 860. Moreover, the orientation feature 865 may be used to align the downhole deflector assembly 910 with the first and second lateral wellbores 830, 840. In the particular embodiment of FIG. 9, the first smaller opening in the downhole deflector assembly 910 is aligned with the first lateral wellbore 830, and the second larger opening in the downhole deflector assembly 910 is aligned with the second lateral wellbore 840.

Figure 10:
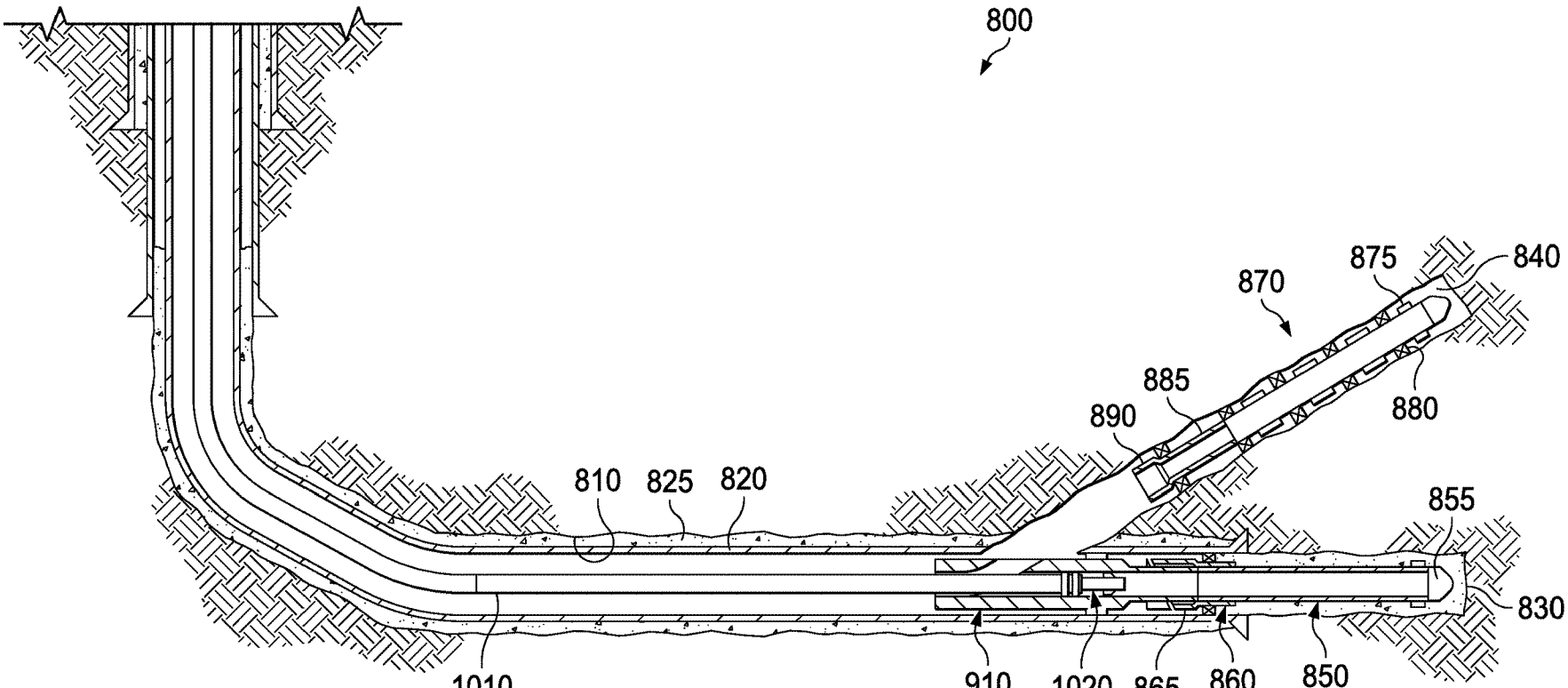

Turning to FIG. 10, illustrated is the well system of FIG. 9 after running a work string 1010 with an intervention tool 1020 into the primary wellbore 810. The intervention tool 1020, in the illustrated embodiment of FIG. 10, is a fracturing tool. Notwithstanding, other intervention tools 1020 designed and manufactured according to the disclosure, including an intervention tool similar to that discussed above with respect to FIGS. 2A-6B, could be used. In the embodiment of FIG. 10, the intervention tool 1020 is deactivated, and thus the intervention tool is in an operational state similar to that illustrated in FIG. 3A above. According to this operational state, the intervention tool 1020 is allowed to pass through the downhole deflector assembly 910 toward the first lateral wellbore 830.

Figure 11:
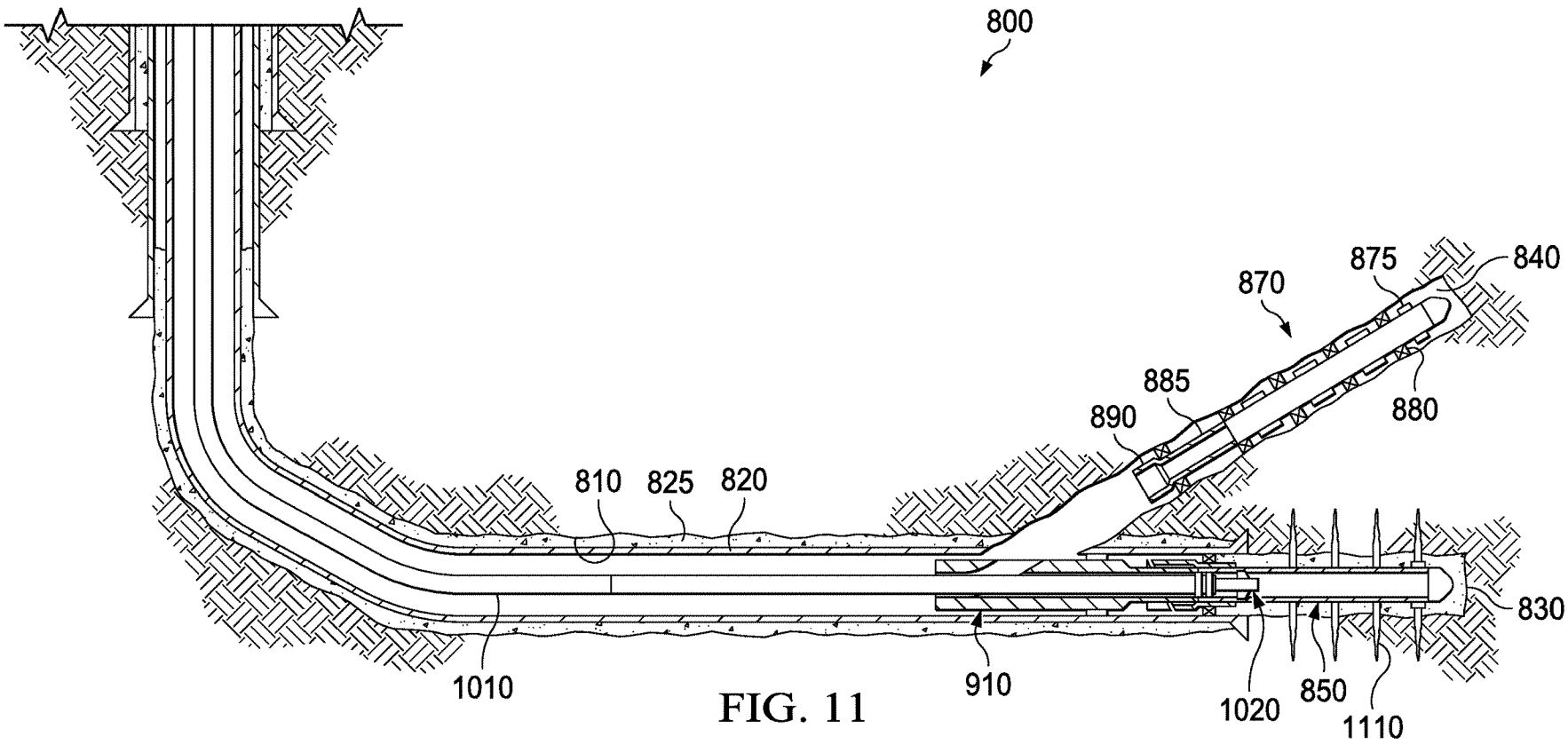

Turning to FIG. 11, illustrated is the well system of FIG. 10 after stabbing the intervention tool 1020 into the first lateral completion 850. With the intervention tool 1020 appropriately placed within the first lateral completion 850, the intervention tool 1020 may be activated to lock itself within the first lateral completion 850. Such an activation may include placing a drop ball or plug within the wellbore, and conducting one or more pressure up/down sequences to lock the intervention tool 1020 in the first lateral completion 850. In one embodiment, three pressure up/down sequences are conducted to place the intervention tool 1020 in an operational state similar to that illustrated in FIG. 3D above. Thereafter, a fracturing sequence may be conducted on the first lateral wellbore 830, thereby forming fractures 1110 therein.

Figure 12:
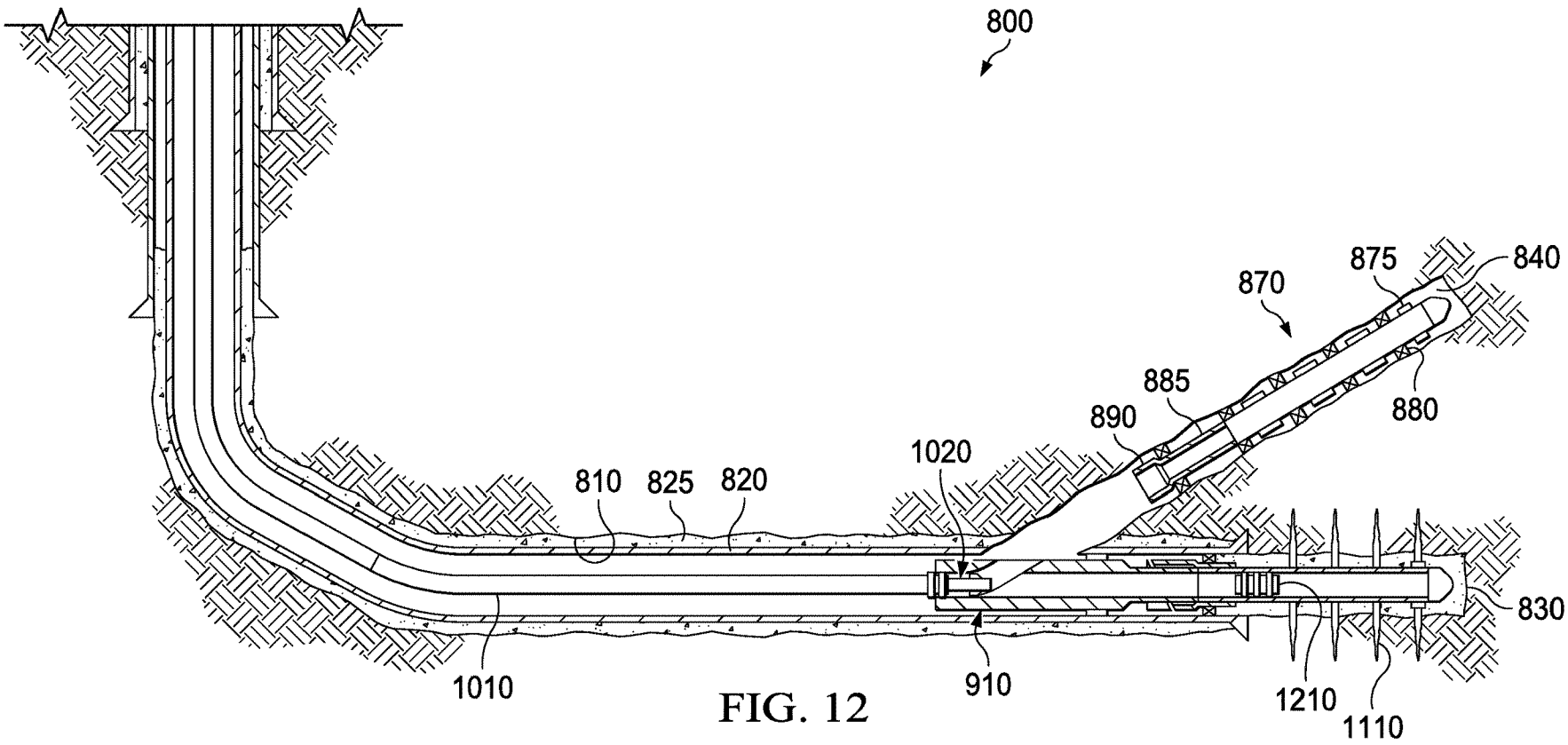

Turning to FIG. 12, illustrated is the well system of FIG. 11 after setting a through tubing bridge plug 1210 in the first lateral wellbore 830. The through tubing bridge plug 1210 may be deployed using the work string 1010, for example prior to withdrawing the work string 1010 and intervention tool 1020 entirely from the first lateral wellbore 830. With the through tubing bridge plug 1210 appropriately placed, the work string 1010 may be moved downhole, thereby resetting the intervention tool 1020 and thus moving the expansion member to its radially retracted position, such as illustrated and described with respect to FIG. 3E above.

With the expansion member in its radially retracted position, the work string 1010 and intervention tool 1020 may be withdrawing (e.g., at least partially) uphole, as shown in FIG. 12.

Figure 13:
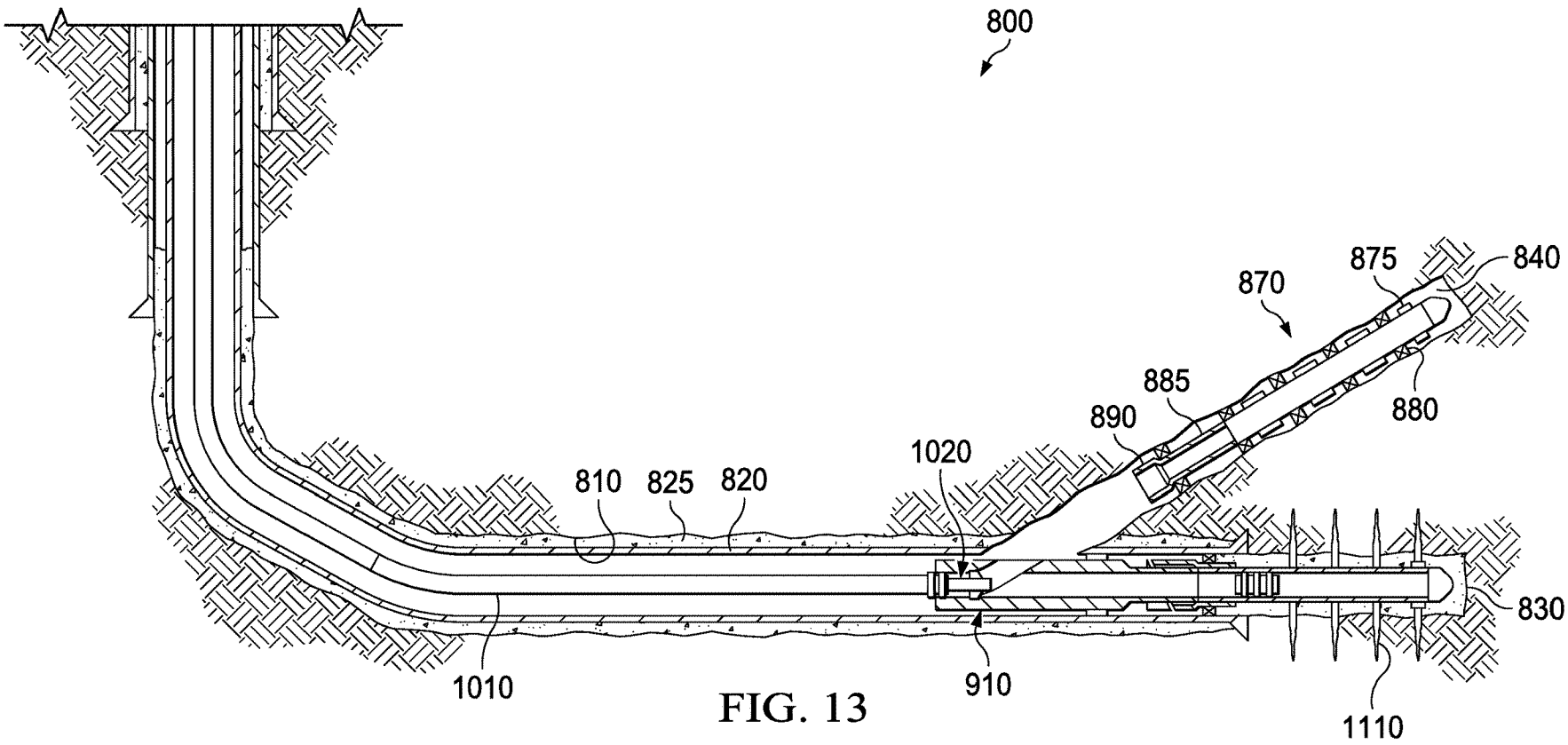

Turning to FIG. 13, illustrated is the well system of FIG. 12 after activating the intervention tool 1020 prior to (or simultaneously with) the intervention tool 1020 entering the downhole deflector assembly 910. Such an activation may include placing a drop ball or plug within the wellbore, and conducting a (e.g., single) pressure up/down sequence to move the expansion member to is radially expanded position. In one embodiment, the pressure up/down sequence is conducted to place the intervention tool 1020 in an operational state similar to that illustrated in FIG. 3B above.

Figure 14:
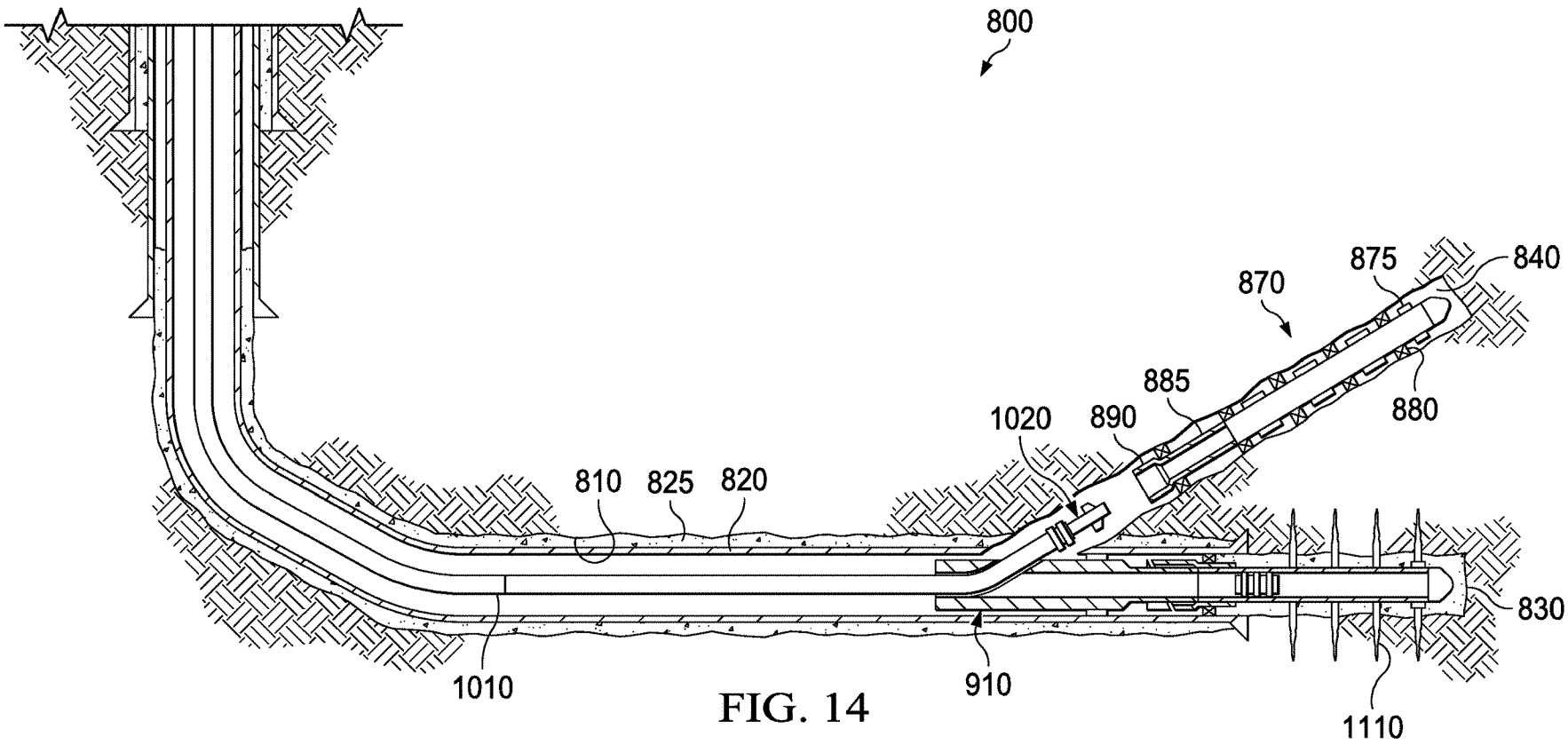

Turning to FIG. 14, illustrated is the well system of FIG. 13 after urging the work string 1010 and intervention tool 1020 downhole. As the intervention tool 1020 is in the activated state, and thus the expansion member is in its radially expanded position, the work string 1010 and the intervention tool 1020 deflect into the second lateral wellbore 840. For example, as a result of the larger diameter created as a result of the expansion member being in the radially expanded position, the intervention tool 1020 follows the second larger opening in the downhole deflector assembly 910, as opposed to the first smaller opening.

Figure 15:
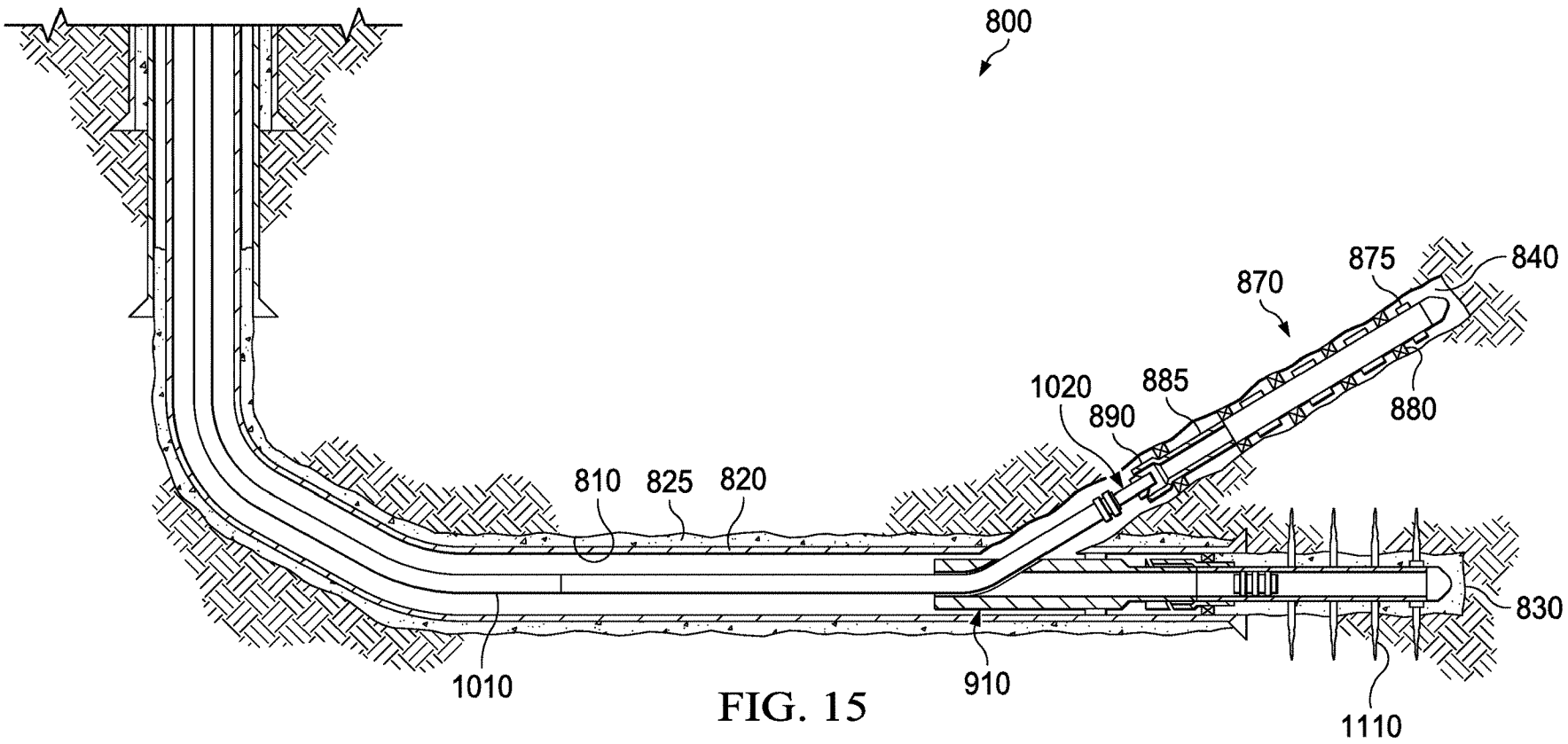

Turning to FIG. 15, illustrated is the well system of FIG. 14 after subjecting the intervention tool 1020 to a second (e.g., single) pressure up/down sequence to move the expansion member back to its radially retracted position. The second pressure up/down sequence places the intervention tool 1020 in an operational state similar to that illustrated in FIG. 3C above.

Figure 16:
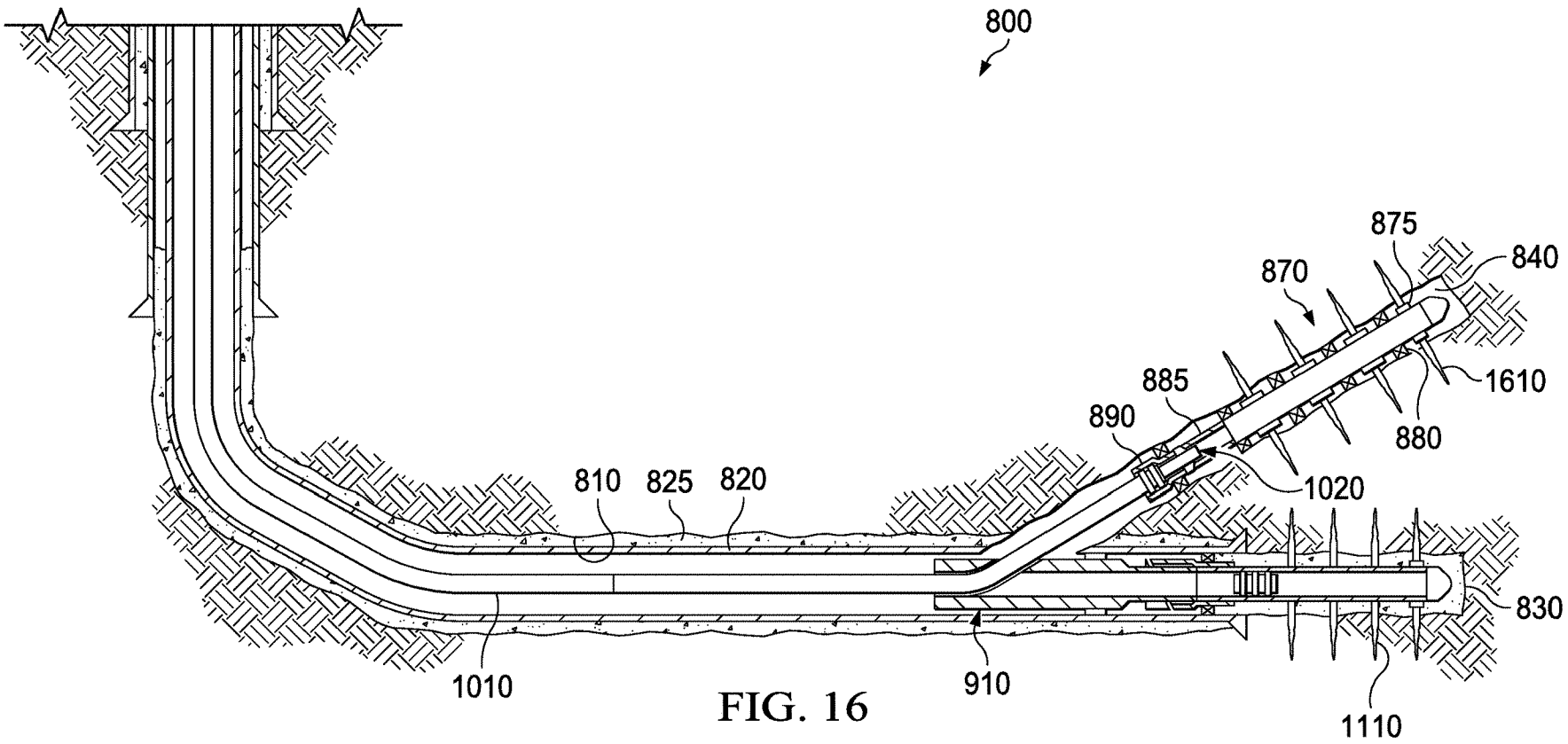

Turning to FIG. 16, illustrated is the well system of FIG. 15 after stabbing the intervention tool 1020 into the second lateral completion 870. Specifically, in the embodiment of FIG. 16 the intervention tool 1020 has been stabbed into the lockdown sub 890. With the intervention tool 1020 appropriately placed within the lockdown sub 890, the intervention tool 1020 may be subjected to a third (e.g., single) pressure up/down sequence to move the expansion member back to its radially expanded position. The third pressure up/down sequence places the intervention tool 1020 in an operational state similar to that illustrated in FIG. 3D above, and thus locks the intervention tool 1020 within the lockdown sub 890. Thereafter, a fracturing sequence may be conducted on the second lateral wellbore 840, thereby forming fractures 1610 therein.

At this stage, the work string 1010 may be moved downhole, thereby resetting the intervention tool 1020 and thus moving the expansion member to its radially retracted position, such as illustrated and described with respect to FIG. 3E above. With the expansion member in its radially retracted position, the work string 1010 and intervention tool 1020 may be withdrawn entirely uphole, or the process described with regard to FIGS. 12-16 may be repeated in another lateral wellbore. It should be noted that while the method illustrated in FIGS. 8-16 focuses on the first lateral wellbore 830 first, and then turns to the second lateral wellbore 840, any sequence may be used. Accordingly, the method could have just as easily fractured the second lateral wellbore 840 first, and the first lateral wellbore 830 thereafter. Therefore, the present disclosure should not be limited to any specific fracturing order.

Moreover, while only two lateral wellbores have been illustrated and described with regard to FIGS. 8-16, other embodiments may exist wherein three or more lateral wellbores exist. Accordingly, the method according to the present disclosure is equally applicable to well systems including three or more lateral wellbores.

Aspects disclosed herein include:

A. An intervention tool, the intervention tool including a radial outer housing, the radial outer housing forming an interior bore configured to flow fluid, an expansion member coupled proximate an outer surface of the radial outer housing, and a sliding sleeve positioned along an interior surface of the radial outer housing and engageable with the expansion member, the sleeve including a collection of slots or catches configured to move the expansion member between a radially retracted position when the sliding sleeve is in a first linear position and a radially expanded position when the sliding sleeve is in a second linear position.

B. A method for fracturing multiple lateral wellbores in a well system, the method including urging an intervention tool downhole within a wellbore proximate a junction between a first lateral wellbore and a second lateral wellbore, the intervention tool including 1) a radial outer housing, the radial outer housing forming an interior bore configured to flow fluid, 2) an expansion member coupled proximate an outer surface of the radial outer housing, and 3) a sliding sleeve positioned along an interior surface of the radial outer housing and engageable with the expansion member, the sleeve including a collection of slots or catches configured to move the expansion member between a radially retracted position when the sliding sleeve is in a first linear position and a radially expanded position when the sliding sleeve is in a second linear position; positioning a drop ball or plug within the wellbore, the drop ball or plug seating with a catch coupled to and extending radially inward from the sliding sleeve, and subjecting the intervention tool having the drop ball or plug seated against the catch to a pressure up/down sequence to move the expansion member between the radially retracted position and the radially expanded position.

Aspects A and B may have one or more of the following additional elements in combination: Element 1: wherein the plurality of slots or catches are a collection of J-slots in the sliding sleeve that engage one or more position pins associated with the radial outer housing. Element 2: wherein the one or more J-slots include a first slot configured to move the expansion member to a first radially retracted position, a second slot configured to move the expansion member to a second radially expanded position, a third slot configured to move the expansion member to a third radially retracted position, and a fourth slot configured to move the expansion member to a fourth modified radially expanded position. Element 3: wherein the first and third slots are substantially similarly shaped. Element 4: wherein the one or more position pins are coupled to and rotate about the radial outer housing. Element 5: further including a catch coupled to and extending radially inward from the sliding sleeve for engaging a drop ball or plug. Element 6: wherein the catch is a ball catch finger collet. Element 7: wherein the catch is a ball catch seat ring. Element 8: further including a release tab at least partially enclosed within a slot in the radial outer housing, and further wherein the catch is movable to enter the slot and engage the release tab, the release tab and catch configured to removably affix the intervention tool within a lockdown sub during an intervention process. Element 9: wherein the catch is located proximate an end of the sliding sleeve near the expansion member. Element 10: wherein the catch is located proximate an end of the sliding sleeve distal the expansion member. Element 11: wherein the expansion member is a collet C-ring. Element 12: wherein the expansion member is a collet barrel ring. Element 13: further including a spring member positioned between a shoulder of the radial outer housing and a shoulder of the sleeve, the spring member configured to assist in moving the expansion member between the radially expanded position and the radially retracted position. Element 14: wherein the one or more slots or catches are configured to keep the expansion member in the radially retracted position or radially expanded position without continuous fluid pressure on the sliding sleeve. Element 15: wherein the pressure up down sequence is a first pressure up/down sequence that moves the expansion member from the radially retracted position to the radially expanded position, and further including urging the intervention tool having the expansion member in the radially expanded position downhole toward a downhole deflector assembly located proximate the junction between the first lateral wellbore and the second lateral wellbore to deflect the intervention tool into the second lateral wellbore. Element 16: further including subjecting the intervention tool having the drop ball or plug seated against the catch to a second pressure up/down sequence to move the expansion member from the radially expanded position to the radially retracted position, and then stabbing the intervention tool having the expansion member in the radially retracted position into a lockdown sub in the second lateral wellbore. Element 17: further including subjecting the intervention tool having the drop ball or plug seated against the catch to third pressure up/down sequence to move the expansion member from the radially retracted position to the radially expanded position to lock the intervention tool within the lockdown sub. Element 18: wherein the third pressure up/down sequence releases the drop ball or plug downhole past the intervention tool, and further including subjecting the lateral wellbore to a fracturing process after the third pressure up/down sequence.

Those skilled in the art to which this application relates will appreciate that other and further additions, deletions, substitutions and modifications may be made to the described embodiments.

What is claimed is:

1. An intervention tool, comprising:

a radial outer housing, the radial outer housing forming an interior bore configured to flow fluid;

an expansion member coupled proximate an outer surface of the radial outer housing; and a sliding sleeve positioned along an interior surface of the radial outer housing and physically engageable with the expansion member, the sleeve including a collection of slots or catches configured to engage one or more catches or slots associated with the radial outer housing, the sliding sleeve configured to physically push the expansion member from a radially retracted position when the sliding sleeve is in a first linear position to a radially expanded position when the sliding sleeve is in a second linear position.

2. The intervention tool as recited in claim 1, wherein the plurality of slots or catches are a collection of J-slots in the sliding sleeve that engage one or more position pins associated with the radial outer housing.

3. The intervention tool as recited in claim 2, wherein the one or more J-slots include a first slot configured to move the expansion member to a first radially retracted position, a second slot configured to move the expansion member to a second radially expanded position, a third slot configured to move the expansion member to a third radially retracted position, and a fourth slot configured to move the expansion member to a fourth modified radially expanded position.

4. The intervention tool as recited in claim 3, wherein the first and third slots are substantially similarly shaped.

5. The intervention tool as recited in claim 2, wherein the one or more position pins are coupled to and rotate about the radial outer housing.

6. The intervention tool as recited in claim 1, further including a catch coupled to and extending radially inward from the sliding sleeve for engaging a drop ball or plug.

7. The intervention tool as recited in claim 6, wherein the catch is a ball catch finger collet.

8. The intervention tool as recited in claim 6, wherein the catch is a ball catch seat ring.

9. The intervention tool as recited in claim 6, further including a release tab at least partially enclosed within a slot in the radial outer housing, and further wherein the catch is movable to enter the slot and engage the release tab, the release tab and catch configured to removably affix the intervention tool within a lockdown sub during an intervention process.

10. The intervention tool as recited in claim 6, wherein the catch is located proximate an end of the sliding sleeve near the expansion member.

11. The intervention tool as recited in claim 6, wherein the catch is located proximate an end of the sliding sleeve distal the expansion member.

12. The intervention tool as recited in claim 1, wherein the expansion member is a collet C-ring.

13. The intervention tool as recited in claim 1, wherein the expansion member is a collet barrel ring.

14. The intervention tool as recited in claim 1, further including a spring member positioned between a shoulder of the radial outer housing and a shoulder of the sleeve, the spring member configured to assist in moving the expansion member between the radially expanded position and the radially retracted position.

15. The intervention tool as recited in claim 1, wherein the one or more slots or catches are configured to keep the expansion member in the radially retracted position or radially expanded position without continuous fluid pressure on the sliding sleeve.

16. A method for fracturing multiple lateral wellbores in a well system, comprising:

urging an intervention tool downhole within a wellbore proximate a junction between a first lateral wellbore and a second lateral wellbore, the intervention tool including:

a radial outer housing, the radial outer housing forming an interior bore configured to flow fluid;

an expansion member coupled proximate an outer surface of the radial outer housing; and a sliding sleeve positioned along an interior surface of the radial outer housing and physically engageable with the expansion member, the sleeve including a collection of slots or catches configured to engage one or more catches or slots associated with the radial outer housing, the sliding sleeve configured to physically push the expansion member from a radially retracted position when the sliding sleeve is in a first linear position to a radially expanded position when the sliding sleeve is in a second linear position;

positioning a drop ball or plug within the wellbore, the drop ball or plug seating with a catch coupled to and extending radially inward from the sliding sleeve; and subjecting the intervention tool having the drop ball or plug seated against the catch to a pressure up/down sequence to move the expansion member between the radially retracted position and the radially expanded position.

17. The method as recited in claim 16, wherein the pressure up down sequence is a first pressure up/down sequence that moves the expansion member from the radially retracted position to the radially expanded position, and further including urging the intervention tool having the expansion member in the radially expanded position downhole toward a downhole deflector assembly located proximate the junction between the first lateral wellbore and the second lateral wellbore to deflect the intervention tool into the second lateral wellbore.

18. The method as recited in claim 17, further including subjecting the intervention tool having the drop ball or plug seated against the catch to a second pressure up/down sequence to move the expansion member from the radially expanded position to the radially retracted position, and then stabbing the intervention tool having the expansion member in the radially retracted position into a lockdown sub in the second lateral wellbore.

19. The method as recited in claim 18, further including subjecting the intervention tool having the drop ball or plug seated against the catch to third pressure up/down sequence to move the expansion member from the radially retracted position to the radially expanded position to lock the intervention tool within the lockdown sub.

20. The method as recited in claim 19, wherein the third pressure up/down sequence releases the drop ball or plug downhole past the intervention tool, and further including subjecting the lateral wellbore to a fracturing process after the third pressure up/down sequence.

* * * * *